US008381802B2

(12) United States Patent
Nishino et al.

(10) Patent No.: US 8,381,802 B2
(45) Date of Patent: Feb. 26, 2013

(54) HEAT TRANSFER DEVICE

(75) Inventors: Kouichi Nishino, Yokohama (JP); Gil-Dal Song, Yokohama (JP)

(73) Assignee: National University Corporation Yokohama National University, Yokohama-Shi, Kanagawa (JP)

( * ) Notice: Subject to any disclaimer, the term of this patent is extended or adjusted under 35 U.S.C. 154(b) by 1148 days.

(21) Appl. No.: 12/087,158

(22) PCT Filed: Dec. 27, 2006

(86) PCT No.: PCT/JP2006/326387

§ 371 (c)(1), (2), (4) Date: Jun. 27, 2008

(87) PCT Pub. No.: WO2007/077968

PCT Pub. Date: Jul. 12, 2007

(65) Prior Publication Data

US 2009/0014159 A1 Jan. 15, 2009

(30) Foreign Application Priority Data

Dec. 28, 2005 (JP) ..... 2005-380338

(51) Int. Cl.
*F28F 13/12* (2006.01)

(52) U.S. Cl. ..... 165/109.1; 165/151

(58) Field of Classification Search ..... 165/109.1, 165/151, 172, 181, 182
See application file for complete search history.

(56) References Cited

U.S. PATENT DOCUMENTS 4,997,036 A * 3/1991 Schulze et al. ..... 165/182
2004/0194936 A1 10/2004 Torii et al.

FOREIGN PATENT DOCUMENTS

| | | | |
|---|---|---|---|
| JP | 61-099097 | A | 5/1986 |
| JP | 61-110889 | A | 5/1986 |
| JP | 61-091495 | A | 9/1986 |
| JP | 3-8479 | B | 1/1991 |
| JP | 07-21799 | A | 1/1995 |
| JP | 08-291988 | A | 11/1996 |
| JP | 11-118379 | A | 4/1999 |
| WO | 03/014649 | | 2/2003 |

* cited by examiner

*Primary Examiner* — Teresa Walberg
(74) *Attorney, Agent, or Firm* — Jacobson Holman PLLC

(57) ABSTRACT

This invention provides a heat transfer device which can improve its heat transfer performance in a heat exchanger with a flow rate of heat carrier fluid being set at a relatively low velocity, while restricting increase in pressure loss of the fluid flow. Plural longitudinal vortex generator winglets (10) are arranged in a spanwise direction on each side of the heat transfer object (T). The winglets on each side are oriented substantially in the same direction for deflecting the fluid to the same direction and conducting the fluid to an area behind the object. Each of the winglets has a configuration gradually decreasing in its height toward an upstream side of a flow of the fluid. Longitudinal vortices are produced behind the winglets by the fluid flowing rearward beyond the winglets.

9 Claims, 18 Drawing Sheets

I-I SECTION (A)

COMPARATIVE EXAMPLE-1

(A)

(B)

COMPARATIVE EXAMPLE-2

(A)

(B)

EXAMPLE-1

EXAMPLE-2

EXAMPLE-3

EXAMPLE-4

EXAMPLE-5

EXAMPLE-6

HEAT TRANSFER DEVICE

CROSS-REFERENCE TO RELATED APPLICATIONS

This is a national stage of PCT/JP06/326387 filed Dec. 27, 2006 and published in Japanese.

BACKGROUND OF THE INVENTION

1. Field of the Invention

The present invention relates to a heat transfer device, and more specifically, to such a device provided with longitudinal vortex generator winglets functioning as means for restricting separation of heat carrier fluid and means for generating longitudinal vortices.

2. Description of Related Art

In general, a heat exchanger for heating or cooling a fluid is provided with a heat transfer tube through which a thermal medium fluid to be heated or cooled is circulated, and the heat exchanger is so arranged that a heat carrier fluid, such as air, is forcedly moved around the tube. The thermal medium fluid in the tube is cooled or heated by heat exchange with the heat carrier fluid through a tube wall of the tube. In such a heat exchanger using gaseous fluid as the heat carrier fluid, a heat transfer performance depends on the thermal resistance of the heat carrier fluid (e.g., air), and therefore, fins in a variety of forms are attached to the tubes for increasing the heat transferable contact area between the tube and the heat carrier fluid as well as improving the heat transfer performance.

For instance, a high-fin-tube type of heat exchanger which has spiral metal fins attached to metal tubes and the tubes disposed in a staggered arrangement or an in-line arrangement, or a fin-tube type or plate-fin-and-tube type of heat exchanger known as a kind of compact heat exchanger are incorporated in thermal medium circuits of various power plants, thermal carrier circuits of air-conditioning systems, cooling water circuits of various internal combustion engines, and so forth.

This kind of heat exchanger cools the thermal medium fluid through the heat transfer tube by heat exchange of the fluid in the tube with the gaseous flow surrounding the tube. The fin increases the heat transferable area of the tube so as to improve the thermal efficiency of heat exchange between the gaseous flow outside the tube and the fluid inside the tube. As such a fin-tube type heat-exchanger intended to improve its heat exchange performance, a heat exchanger provided with a number of dimples or slits formed on the fins, or a heat exchanger provided with cut and elevated parts formed on the fins for improving its heat exchange efficiency are know in the art (Japanese patent laid-open publications Nos. 11-118379, 7-217999, 8-291988, 61-110889 and so forth).

However, even if the heat transfer effect can be augmented by improvement of configuration of the fin, the pressure loss of the gaseous fluid passing through the heat exchanger greatly increases on the contrary. Therefore, it has been understood to be difficult to realize both augmentation of heat transfer and reduction (or restriction of increase) of pressure loss of the gaseous flow by improving the configuration of the fin.

Technique for improving the heat transfer effect of the heat exchanger without increase of the pressure loss of gaseous flow is disclosed in PCT International Publication (PCT Pamphlet) No. WO2003/014649. In this technique, a heat transfer device of the heat exchanger is provided with vortex generator means (Vortex Generator) generating a longitudinal vortex for augmentation of the heat transfer effect and spouting air flow toward a dead water zone behind the heat transfer tube. The vortex generator means is the delta-winglet positioned in close proximity of the tube. The gaseous fluid flowing near the tube is accelerated by the delta winglet and a swirling flow is caused on the rear of the winglet, whereby the heat transfer effect of the heat exchanger is enhanced by means of restriction of separation, reduction of a dead water area and generation of the longitudinal vortex.

The vortex generator means disclosed in PCT International Publication No. WO2003/014649 is constituted from the delta winglets in a pair, which are intended to reduce the separation wake zone behind the tube and cause the longitudinal vortex behind the winglet by means of the gaseous flow getting over the winglet, thereby augmenting the heat transfer effect of the heat exchanger without increasing the pressure loss of the gaseous flow.

In general, if the flow rate of the gaseous flow (the velocity of the flow) is increased for enhancement of the heat transfer performance, the pressure loss of the gaseous flow is considerably increased in association with increase of the Reynolds number of the air flow. Therefore, according to understanding of those skilled in the art, it is difficult to attain both enhancement of the heat transfer effect and restriction of increase in the pressure loss. However, in the heat exchanger with the aforementioned vortex generator means, augmentation of the heat transfer effect is significant in comparison with increase of the pressure loss in a case where the Reynolds number of the gaseous flow is increased. This advantage is considered to be remarkable, and the vortex generator means can exhibit the expected effect in a relatively large-scale heat-exchanger with the gaseous flow rate being set at a relatively high velocity. However, it has been found that the vortex generator means is difficult to exhibit the effective heat transfer effect in a relatively small-scale heat-exchanger with the gaseous flow rate being set at a relatively low velocity. Therefore, it is considered to be difficult to realize a relatively small-scale heat-exchanger, which achieves both enhancement of the heat transfer effect and restriction of increase in the pressure loss, by means of the vortex generator means only in a pair.

In Japanese patent laid-open publications Nos. 61-99097 and 61-91495, heat transfer devices are disclosed in which a plurality of elevated rectangular walls are arranged along a streamwise direction of the gaseous flow. Even if these walls can generate longitudinal vortices, the vortices caused by the respective walls interfere with each other. Therefore, long continuance of the longitudinal vortex cannot be attained, and the heat transfer device is difficult to exhibit the desired heat transfer effect.

It is a purpose of the present invention to provide a heat transfer device which can improve the heat transfer effect in a heat exchanger with the flow rate of the heat carrier fluid being set at a relatively low velocity, while restricting increase of the pressure loss of the fluid flow.

BRIEF SUMMARY OF THE INVENTION

For attaining the above purpose of this invention, the present invention provides a heat transfer device having a linear or tubular heat transfer object which is in heat transfer contact with a heat carrier fluid, a heat transfer fin which is formed integrally with the heat transfer object for heat transmission between the fin and the heat transfer object, and a plurality of longitudinal vortex generator winglets on the fin, each of which causes the fluid in vicinity of the heat transfer object to be conducted to a separation wake zone behind the object for reducing the separation wake zone, and which generates a longitudinal vortex behind the winglet, comprising;

the plurality of the winglets being arranged in a spanwise direction on each side of the heat transfer object, wherein the winglets on each side are oriented substantially in the same direction for deflecting the fluid to the same direction and conducting the fluid to an area behind the object, and wherein each of the winglets has a configuration gradually decreasing in its height toward an upstream side of a flow of the fluid so that the longitudinal vortex is produced by the fluid flowing rearward beyond the winglet.

The heat transfer device according to the present invention has the plural vortex generator winglets on each side of the heat transfer object. The winglets are arranged in the spanwise direction. On each side of the object, the plural longitudinal vortices are produced behind the winglets. These vortices extend downward in parallel and continue to the downstream side over a considerable distance, thereby augmenting the heat transfer action between the fluid and the fin. The winglets also conduct the fluid to the rear of the object for reducing the dead water zone, thereby augmenting the heat transfer effect of the object. According to the device of this invention with the winglets arranged on each side of the object, the heat transfer enhancement effect can be improved in a heat exchanger with the flow rate of heat carrier fluid being set at a relatively low velocity, while increase of the pressure loss of the fluid flow is restrained.

The present invention also provides the heat transfer device with the aforementioned arrangement, which has a characteristic of a heat transfer enhancement ratio $(j/j0) \geqq 1.4$ and the heat transfer enhancement ratio (j/j0)/a pressure loss penalty ratio $(f/f0) > 1.0$ set by the vortex generator winglets with respect to the fluid of the Reynolds number Re ranging from 100 to 500, wherein the heat transfer enhancement ratio (j/j0) is defined as a ratio of a dimensionless heat transfer coefficient (j) of the heat transfer device with the winglets relative to the dimensionless heat transfer coefficient (j0) of the heat transfer device without the winglets; and wherein the pressure loss penalty ratio (f/f0) is defined as a ratio of a pressure loss coefficient (f) of the heat transfer device with the winglets relative to the pressure loss coefficient (f0) of the heat transfer device without the winglets.

As previously described, the plural winglets are arranged in parallel in the spanwise direction, and the plural longitudinal vortices continuing downward are produced on each side of the heat transfer object. The heat transfer device is so set that a high value of the heat transfer enhancement ratio $((j/j0) \geqq 1.4)$ is obtained with respect to the fluid of the Reynolds number Re ranging from 100 to 500, and that a property of "Net Heat Transfer Enhancement Area" as described later can be obtained. In the heat exchanger for an air conditioner or the like with such a device incorporated thereinto, the flow rate of the gaseous fluid flow can be set at a relatively low velocity for reducing its noise.

Further, the present invention provides the heat transfer device with the aforementioned arrangement, which has a characteristic of a heat transfer enhancement ratio $(j/j0) \geqq 1.3$ and the heat transfer enhancement ratio (j/j0)/a pressure loss penalty ratio $(f/f0) > 1.0$ with respect to the fluid of the Reynolds number Re=300, and which has the heat transfer enhancement ratio (j/j0) varying under a condition of the heat transfer enhancement ratio (j/j0)/the pressure loss penalty ratio $(f/f0) > 1.5$, in response to change of the Reynolds number in a range from 300 to 500, wherein the heat transfer enhancement ratio (j/j0) is defined as a ratio of a dimensionless heat transfer coefficient (j) of the heat transfer device with the winglets relative to the dimensionless heat transfer coefficient (j0) of the heat transfer device without the winglets; and wherein the pressure loss penalty ratio (f/f0) is defined as a ratio of a pressure loss coefficient (f) of the heat transfer device with the winglets relative to the pressure loss coefficient (f0) of the heat transfer device without the winglets.

According to such an arrangement of the present invention, the heat transfer device exhibits the heat transfer performance of the heat transfer enhancement ratio $(j/j0) \geqq 1.3$ and the heat transfer enhancement ratio (j/j0)/a pressure loss penalty ratio $(f/f0) > 1.0$. When the Reynolds number of the fluid is changed from 300 to 500, the heat transfer enhancement ratio (j/j0) varies in rate of 1.5 times or more in comparison with the change of the pressure loss penalty ratio (f/f0). Therefore, in such a heat transfer device, change of the pressure loss is not so changed in response to increase in the flow rate of the fluid, but the heat transfer effect is mainly enhanced in response to increase in the flow rate of the fluid. In an air conditioner and so forth with such a heat transfer device incorporated thereinto, the heat transfer performance can be considerably changed by a relatively slight change of the flow rate, and therefore, responsiveness of the heat transfer performance is improved with respect to the change of the flow rate.

DETAILED DESCRIPTION OF THE INVENTION

Figure 1:
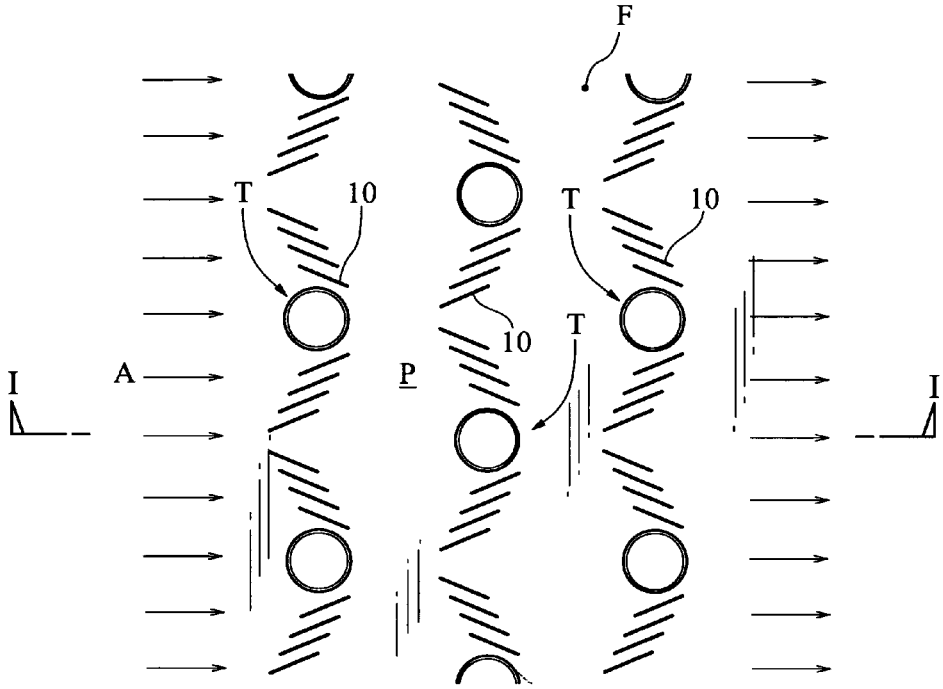
FIG. 1 is a cross-sectional view showing a construction of a plate-fin-and-tube type of heat exchanger.

Best Mode for Carrying Out the Invention

According to a preferred embodiment of the present invention, the vortex generator winglet has a delta profile with its base being positioned on a plane of a heat transfer fin, and an oblique line of the delta defines an upper edge inclining toward an upstream side of a heat carrier fluid flow. The fluid flow, which impinges on the winglet with such a profile, generates a longitudinal vortex without subjecting to a large fluid resistance when surmounting the winglet. For instance, such a winglet can be integrally formed on the fin by partially cutting and elevating the fin.

Preferably, the vortex generator winglets in three or four pairs are disposed on both sides of a heat transfer object in symmetry, and the winglets on the same side are positioned substantially parallel to each other. An attack angle of the winglet with respect to a streamwise direction of the heat carrier fluid is set to be a predetermined angle in a range from 5 degrees to 60 degrees (5-60 degrees), preferably in a range from 10 degrees to 45 degrees (10-45 degrees), and more preferably in a range from 10 degrees to 30 degrees (10-30 degrees). The adjacent winglets located on the same side of the heat transfer object are spaced apart at a predetermined distance in a spanwise direction so as not to cause interaction between the longitudinal vortices generated by the respective winglets. Preferably, the adjacent winglets are partially overlapped in a spanwise direction (direction of Y-axis) in a range from ⅓ of the winglet to ⅔ of the winglet as seen from the downstream side of the flow.

Preferably, rear ends of the respective winglets are located in positions offsetting in the streamwise direction (direction of X-axis). More preferably, the rear end of the winglet closest to the heat transfer object is placed in a lateral (spanwise) position with respect to the object, or on an upstream side of the rear end portion of the object, and the rear ends of the other winglets are positioned on the further upstream side. The winglet closest to the object is positioned such that a separation point (β) appears at an angular position equal to or larger than 100 degrees from the stagnation point (E) and that the flow is accelerated, whereby the accelerated spouting flow of the heat carrier fluid is directed to the rear of the object at a relatively high velocity. The heat carrier fluid flowing into the rear of the object prevents so-called "dead water zone" from being created behind the object, and therefore, the separation wake zone is considerably reduced or substantially eliminated.

According to a preferred embodiment of the present invention, the aforementioned heat transfer object is a heat transfer tube (T) having a circular cross-section, through which a thermal medium fluid to be heated or cooled can pass, and the overall length (M) of the winglet is set to be greater than a radius (R) of the tube (if desired, greater than a diameter (D) of the tube).

A preferred embodiment of the present invention is described in detail hereinafter, with reference to the attached drawings.

Figure 2:
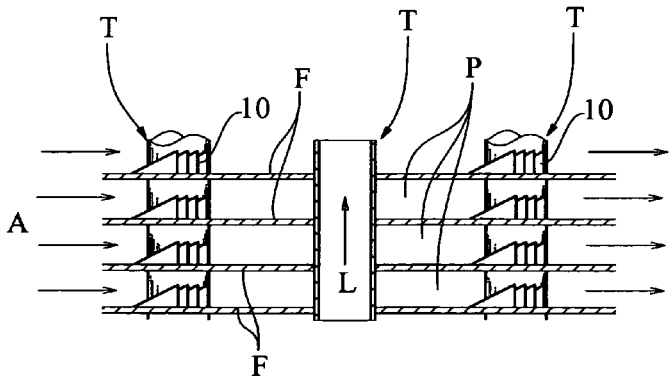
FIG. 2 is a cross-sectional view of the heat exchanger taken along line I-I of FIG. 1.

FIG. 1 is a cross-sectional view showing a construction of a plate-fin-and-tube type of heat exchanger, and FIG. 2 is a cross-sectional view of the heat exchanger taken along line I-I of FIG. 1.

The heat exchanger has a plurality of heat transfer tubes T spaced apart at a predetermined distance from each other and arranged in a formation of staggered tube layout, and a plurality of plate fins F perpendicular to the tubes T which is arranged in alignment with each other. The tube T and the fin F are made of the same metal or different metals. The tube T provides a fluid passage for a thermal medium fluid having a circular cross-section. The tubes T and the fins F thereon are integrally assembled for heat transmission therebetween, so that heat transferable plane surfaces widely spreading are formed within the heat exchanger by the fins F. Fluid passages P, through which a flow of cooling air A can pass, are defined between the fins F.

The thermal medium fluid L at a relatively high temperature circulates through the tubes T. The cooling air flow A is forcedly drafted in a direction perpendicular to the tubes T as the heat carrier fluid for cooling the thermal medium fluid L. The air flow A blows through the heat exchanger while flowing in a boundary layer of the fins F and tubes T as the heat carrier fluid, whereby the air flow A receives the heat of the fins F and tubes T by heat transfer contact therewith. The heated air flow A is exhausted through a downstream exhaust port (not shown) of the heat exchanger.

The heat exchanger is provided with longitudinal vortex generator winglets 10 raised from the fins F. The winglet 10 constitutes separation restriction means for restricting separation of the air flow A from the tube T as well as longitudinal vortex generator means which causes the air flow A to swirl.

Figure 3:
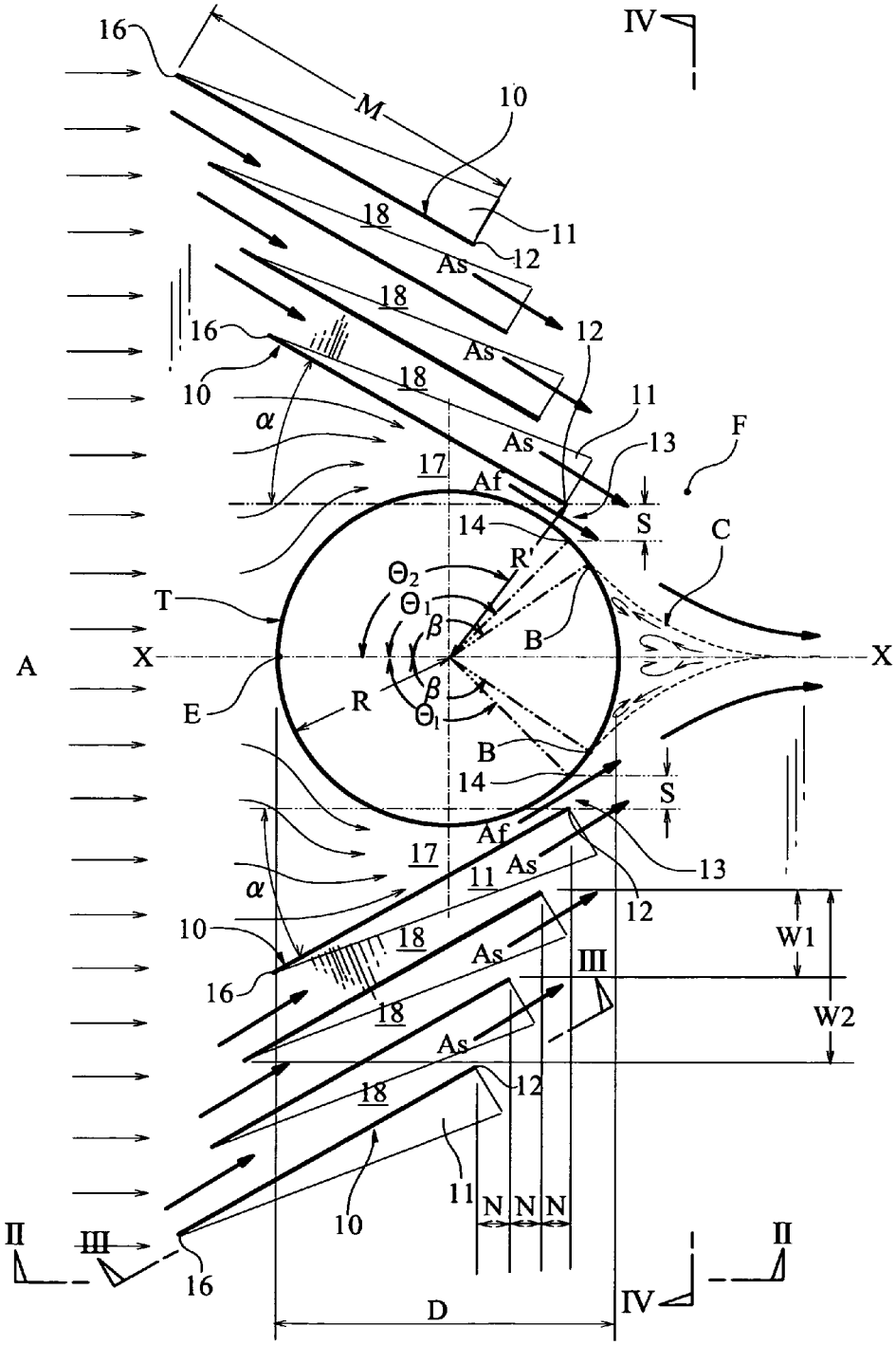
FIG. 3 is a partially enlarged cross-sectional view of the heat exchanger showing the structures and positions of vortex generator winglets.
Figure 4:
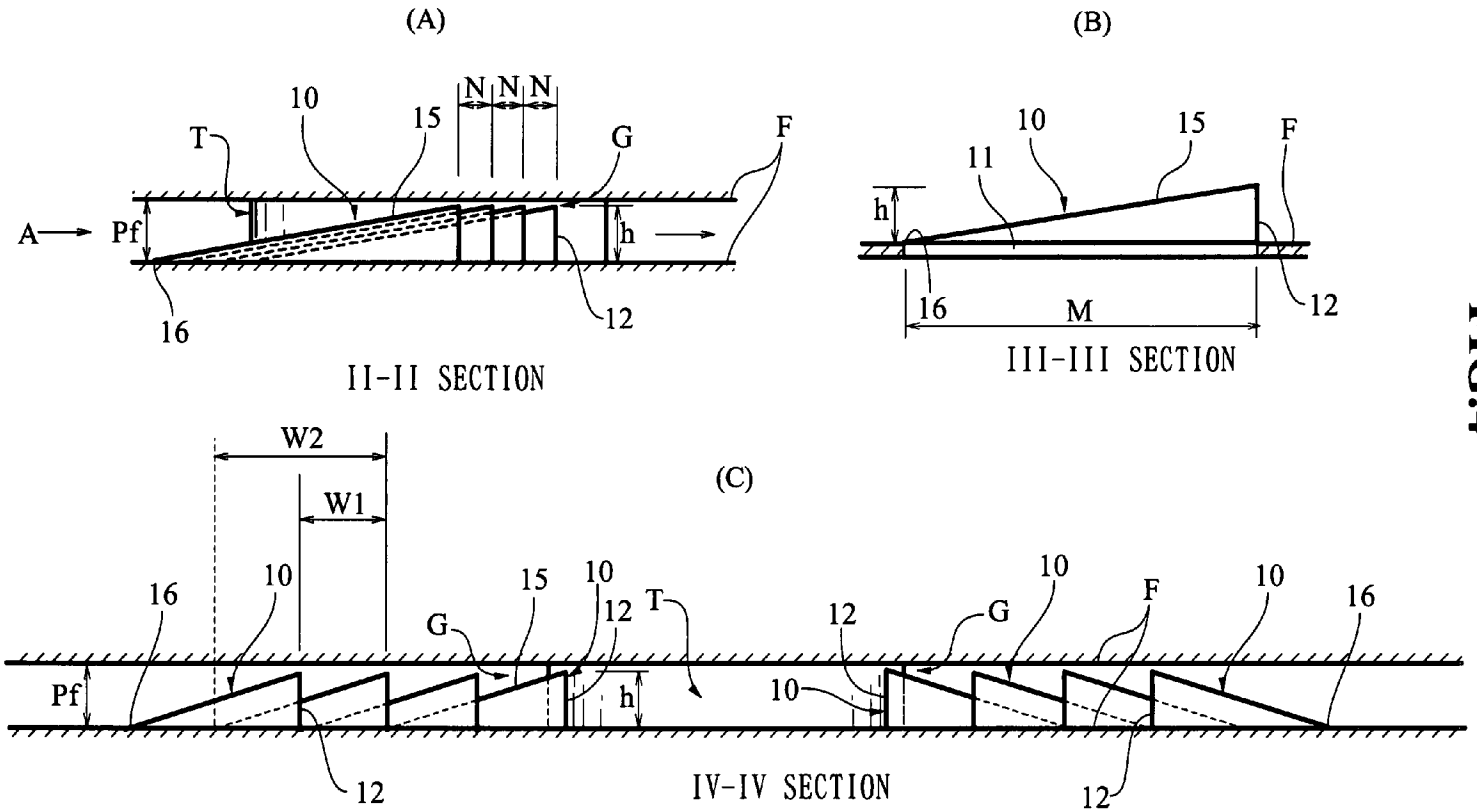
FIG. 4 includes cross-sectional views taken along lines II-II, III-III and IV-IV of FIG. 3.

FIGS. 3 and 4 are partially enlarged cross-sectional views of the heat exchanger as shown in FIG. 1. The structures and positions of the winglets 10 are illustrated in FIGS. 3 and 4.

Each of the longitudinal vortex generator winglets 10 is formed by locally cutting and elevating the fin F in a form of delta (triangle), so that an opening 11 adjacent to the winglet 10 is formed to conform with the outline of the winglet 10. The winglets 10 are disposed on both sides of the tube T. The formation and layout of the winglets 10 are symmetric with respect to a center axis X-X of the tube T extending in the streamwise direction.

Each of the winglets 10 is obliquely oriented at an attack angle α with respect to the streamwise direction of the flow A. The four winglets 10 are located on each side of the tube T. The winglets 10 located on the same side of the tube T are oriented in the same direction (positioned parallel to each other in this embodiment). Downstream and upstream end portions 12, 16 of the winglets 10 are spaced apart from each other and pitched at a predetermined distance N in the streamwise direction of the flow A. A fluid flow passage 17 is formed between the winglet 10 adjacent to the tube T and a tube wall of the tube T. The width of the passage 17 converges toward its downstream side. A narrow gap 13 limited in its fluid passage area is formed between an outer surface of the tube T and the end portion 12 of the winglet 10. Outside of this winglet 10, the three winglets 10 are located, and three fluid flow passages 18 in parallel are defined between these three winglets 10. Each of the passages 18 has a constant width throughout its overall length.

A close point 14 of the tube T, which opposes against the end portion 12 of the winglet 10 in the direction (spanwise direction) perpendicular to the flow A, is spaced a distance S from the end portion 12. The point 14 is positioned at an angle $\theta_1$ measured from a stagnation point E on the tube T. In a cylindrical coordinate of FIG. 3, the end portion 12 is positioned at an angle $\theta_2$ (an angle $\theta_2$ measured from the stagnation point E) and at a distance R' (a distance between the end portion 12 and a center of the tube). Preferably, the angle $\theta_2$ is set to be in a range from 80 degrees to 176 degrees, and a ratio of the distance R'/a radius R of the heat transfer tube is set to be in a range from 1.05 to 2.6. The separation point B appears in the angular position β at an angle equal to or greater than 90 degrees, e.g., 100-135 degrees, with reference to the position of the stagnation point E.

As shown in FIG. 4(B), the winglet 10 is formed in a configuration of right-angled triangle having a base length (leg length) M and an altitude h. As shown in FIG. 3, the opening 11 having the outline identical with that of the winglet 10 is formed adjacently to the base of the winglet 10 on its side opposite to the tube T. The altitude h (the height of the vertex) is set to be a dimension somewhat smaller than the interval (fin pitch) Pf of the fins F. The altitude h is set to be at least one quarter of the fin pitch Pf, preferably, at least one half thereof.

Figure 5:
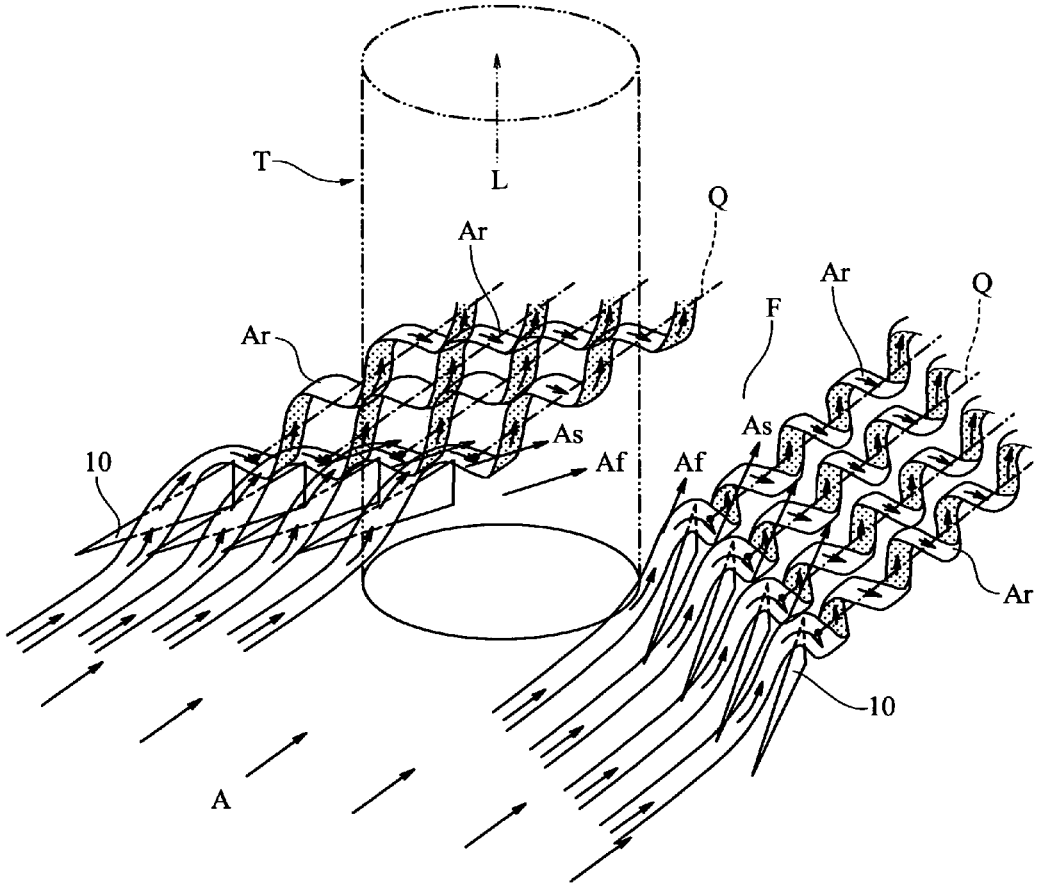
FIGS. 5 and 6 are perspective and rear views schematically showing effects of the winglets generating longitudinal vortices.
Figure 6:
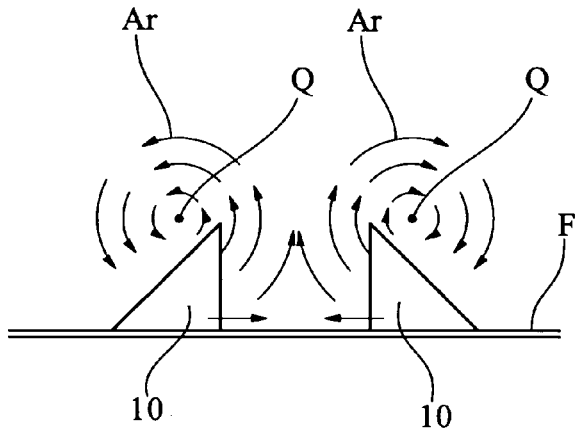
Figure 6:
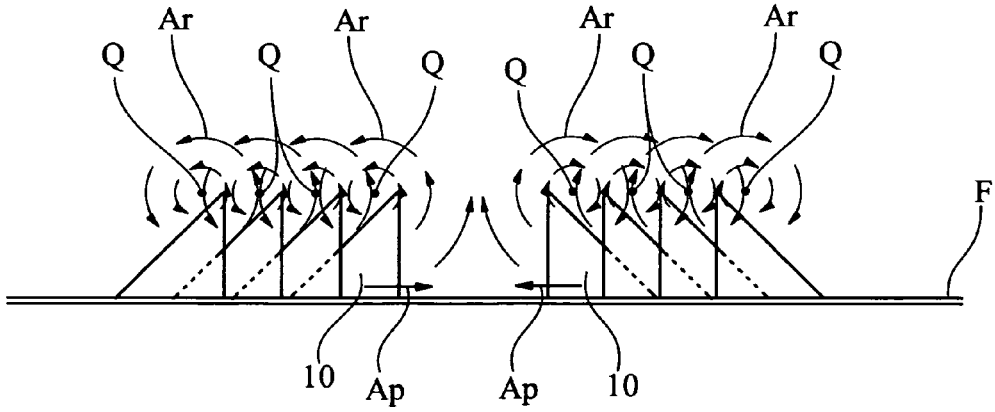

The longitudinal vortex effects of the winglets 10 are shown in FIGS. 5 and 6.

The air flow A is partially deflected by the respective winglets 10, so that the flow A passes toward the region behind the tube T as indicated by the air flow Af or As.

The air flow Af is directed to the rear of the tube T as a spouting air flow at a relatively high velocity, so that the spouting air flow dispels most of a dead water zone of the tube T. Therefore, a separation wake zone C behind the tube T is reduced, as shown in FIG. 3.

The remaining part of the air flow A impinges against the winglet 10 and passes beyond the winglet 10 so as to flow to the rear of the winglet 10. The winglet 10 constitutes the delta-winglet as previously described, which generates the longitudinal vortex, and the air flow passing over the winglet 10 produces a swirling flow Ar. The swirling flow Ar swirls about an axis Q. The axis Q extends approximately along the streamwise direction of the air flow A, and it is deviated to the side of the tube T in relation to the obliquity of the winglet 10.

The delta winglets 10 in a pair produce a pair of the swirling flows Ar in an area between the winglets 10. The flows Ar swirl in opposite turning directions about each of the axes Q in a pair. Each of the swirling flows Ar is a spiral vortex with its axis generally extending along the streamwise direction of the air flow (main flow) A, namely, a longitudinal vortex. The right and left swirling flows Ar turning in clockwise and anticlockwise directions provide Common-Flow-Up Vortices which flow up between the two swirling flows Ar so as to leave from the surface of the fin F. The respective swirling flows Ar turn in the directions in which the swirling motions are enhanced (the directions in which the swirling motions are not cancelled). Therefore, the swirling flows Ar continue to considerably far downstream of the winglet 10.

In this embodiment, the four winglets 10 are provided on each side of the tube T, and each of the winglets causes the swirling flow Ar as shown in FIG. 6(B). As shown in FIG. 5, the winglets 10 cause the swirling flows Ar respectively, which extends downstream in parallel. The winglets 10 are positioned and configured so as not to cancel the longitudinal vortex effects by interaction between the adjacent swirling flows Ar. As shown in FIG. 3, the adjacent winglets 10 are located in the offset positions wherein the winglets are spaced the distance N in the streamwise direction of the air flow A (X-direction as shown in FIGS. 10-15). Further, the adjacent winglets 10 are spaced a distance W1 in the direction perpendicular to the streamwise direction of the air flow A, i.e., in the spanwise direction of the tube T (Y-direction as shown in FIGS. 10-15). For instance, the spacing distance W1 is set to be approximately ½ of a spanwise dimension W2 of the winglet 10. Preferably, the ratio of W1/W2 is set to be in a range from ⅓ to ⅔.

Effects or functions of the winglets 10 are described hereinafter.

As shown in FIG. 3, the air flow A enters the passage 17 between the tube T and the winglet 10. The air flow A passing therethrough gradually accelerates while varying its direction, as the width of the passage 17 between the winglet 10 and the tube T gradually reduces in relation to the inclination of the winglet 10. The air flow A finally spouts rearward through the gap 13 as the air flow Af. The flow spouting through the gap 13 is directed in an approximately tangential direction of the point 14.

The winglet 10 allows the air flow A to be accelerated and stabilized, and also, the winglet 10 conducts the air flow A in a direction along a tube wall surface of the tube T to regulate the direction of spouting flow through the gap 13. The winglet 10, which guides the air flow A, acts to restrict the separation of the air flow A from the tube T, so that occurrence of the separation is retarded or delayed. As the result, a position of the separation point B is displaced considerably rearward, compared to a case where the winglet F is not provided. The angular position β of the separation point B with reference to the position of the stagnation point E is observed to be, e.g., 100-135 degrees. As the result of rearward displacement of the separation point B, the air flow A can smoothly flow to the rear of the tube T, and the pressure loss of the air flow A is reduced. Thus, the winglet 10 adjacent to the tube T acts as separation position control means for controlling the position of the separation point B, so that the position of the separation point B depends on the configuration and position of the winglet 10.

The altitude h of the winglet 10 is set to be smaller than the fin pitch Pf, and therefore, a gap G is provided between an upper edge 15 (FIG. 4) of the winglet 10 and the fin F. A part of the air flow A surmounts the winglet 10 and passes beyond the winglet 10 to the rear thereof, so that the longitudinal vortex flow Ar is generated behind the winglet 10 as previously described. The winglet 10 is oriented in the attack angle α relative to the air flow A and therefore, the gap G extends in a direction of the angle α with respect to the air flow A. Thus, the longitudinal vortex flow Ar is deviated by the winglet 10 so as to approach the tube T.

The air flow A also enters the fluid passage 18 between the winglets 10. The air flow 18 flowing therethrough is deflected to the side of the tube T in dependence on the inclination of the winglet 10, and flows to the rear of the winglet 10 as the air flow As.

A part of the air flow A entering the fluid passage 18 flows beyond the winglet 10 toward the rear thereof, so that the swirling flow (longitudinal vortex) Ar is generated behind the winglet 10 as shown in FIG. 5. Since the winglet 10 is oriented in the attack angle α relative to the air flow A, the swirling flow Ar is deviated to the side of the tube T.

Figure 8:
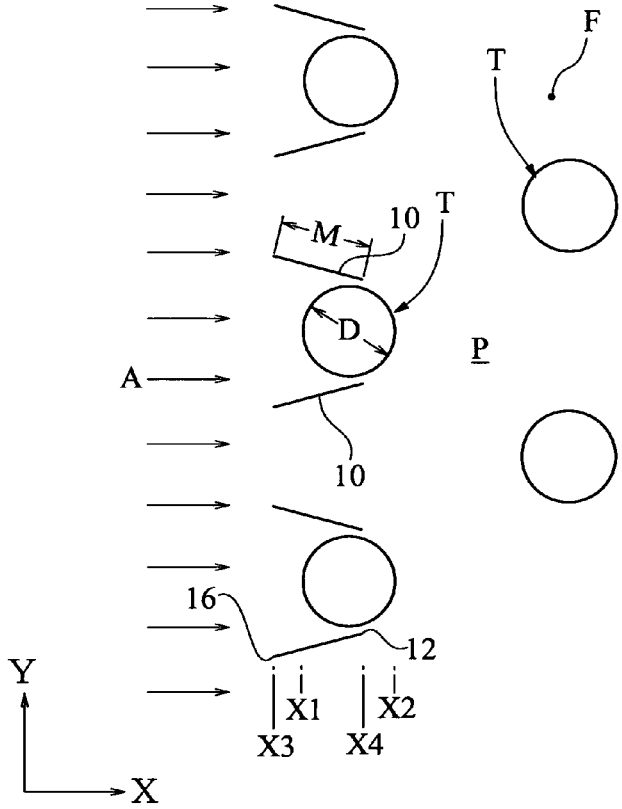
FIGS. 8 and 9 are cross-sectional views schematically illustrating arrangements of the winglets in Comparative Examples-1 and 2 of heat transfer device.
Figure 8:
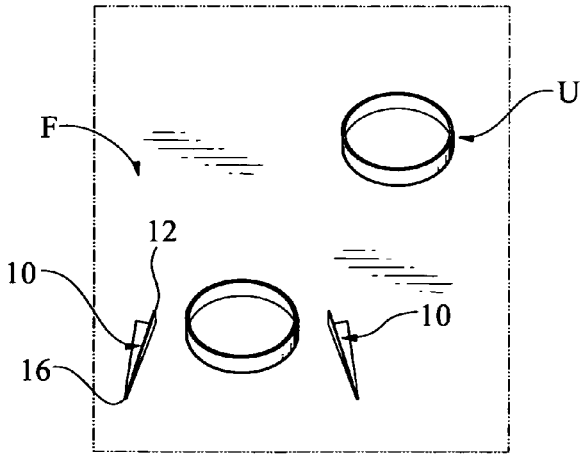

It could be confirmed from distribution of the heat transfer coefficients in the heat transfer device that each of the swirling flows Ar continues to the downstream side over a considerable distance. Therefore, the heat transfer enhancement effect of the heat transfer device can be approximately considered to be aggregative incorporation of the heat transfer enhancement effects of the respective swirling flows Ar. Also, it could be found from the distribution of heat transfer coefficients that the dead water zone of the tube T is further reduced in comparison with the heat transfer device provided with only one pair of winglets 10 (Comparative Example 1 as shown in FIG. 8). This is deemed to result from influences of the air flows spouting rearward through the plural passages 18, effects of the plural swirling flows Ar, influences of the air flows Ap (FIG. 6) inwardly flowing on the surface of the fin F, and so forth.

It is considered that such aggregative heat transfer enhancement effects can be estimated from, e.g., the configurations, sizes and positions of the winglets 10.

Figure 7:
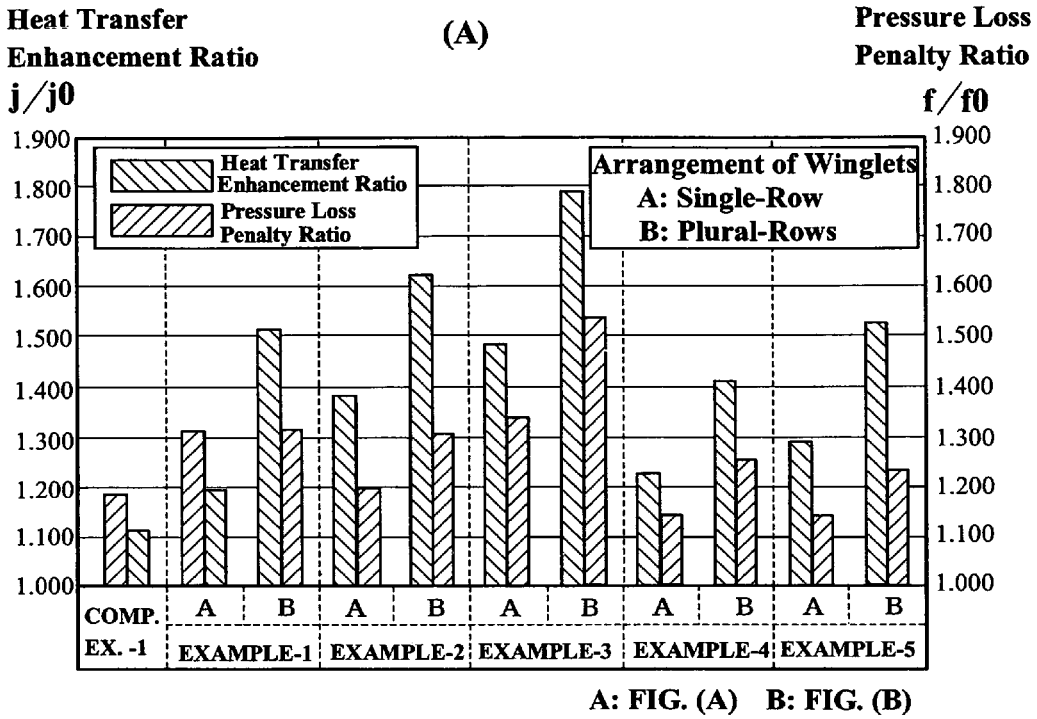
FIG. 7 includes graphic diagrams showing heat transfer enhancement ratios and pressure loss penalty ratios of the winglets in a case of the Reynolds number Re=400.
Figure 7:
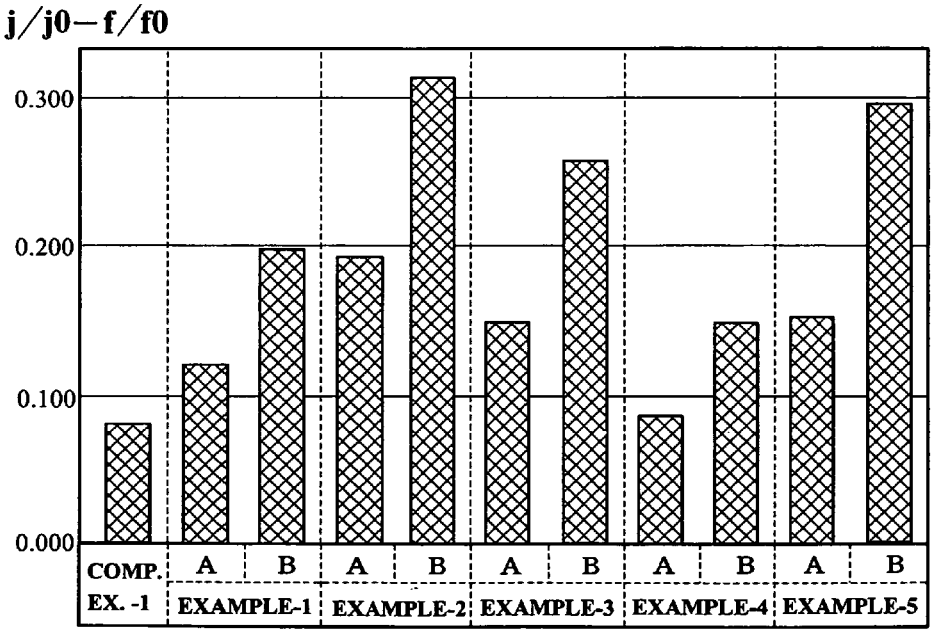

FIG. 7 includes graphic diagrams showing the heat transfer enhancement ratios and the pressure loss penalty ratios of the winglets 10. FIGS. 8 to 15 are cross-sectional views and perspective views schematically showing the various arrangements of the winglets 10. Each of the heat exchangers as shown in FIGS. 8 to 15 has the tubes T arranged in the staggered tube layout. X-axis and Y-axis are indicated in FIGS. 8 to 15, the X-axis being oriented in the direction of the air flow A and the Y-axis being oriented in the direction perpendicular to the air flow A (spanwise direction of the tubes T). In the perspective views of FIGS. 8 to 15, only collars U are illustrated, through which the tubes T can be inserted.

The heat transfer device is illustrated in FIG. 8 as Comparative Example-1, the arrangement of which is substantially the same as that of the heat transfer device as disclosed in PCT International Publication (PCT Pamphlet) No. WO2003/014649. In Example-1, the winglets 10 in a pair constituting the heat transfer device are disposed on both (right and left) sides of the tube T located on the upstream side. The coordinates X3 of the upstream ends 16 of the winglets 10 are positioned on the upstream side of the coordinates X1 of the upstream ends of the tubes T (the stagnation points E). The coordinates X4 of the downstream ends 12 of the winglets 10 are positioned on the upstream side of the coordinates X2 of the downstream ends of the tubes T. The overall length M of the winglet 10 is set to be approximately equal to the diameter D of the tube T.

Figure 9:
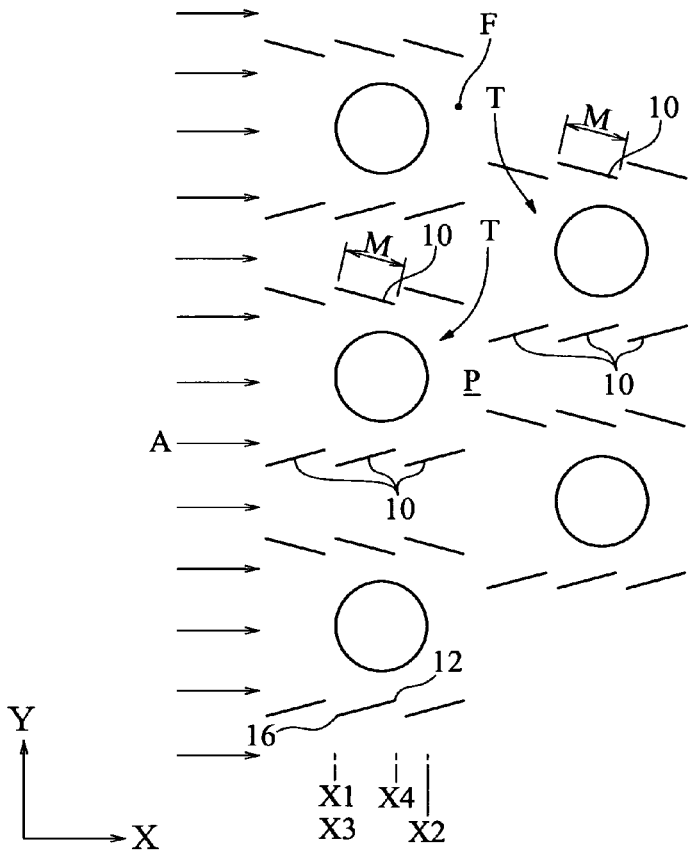
Figure 9:
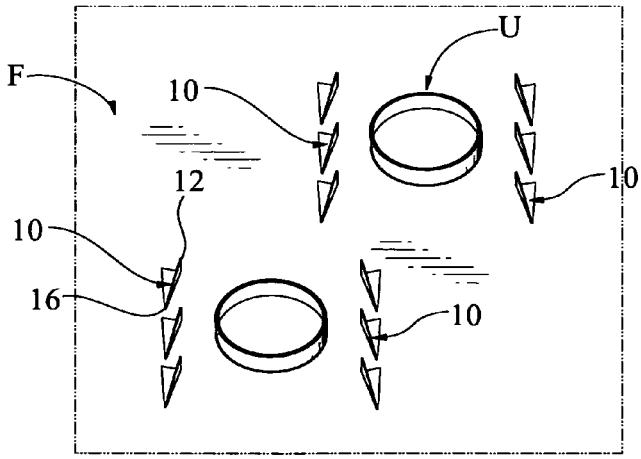

The heat transfer device with the three winglets 10 is illustrated in FIG. 9 as Comparative Example-2, in which the winglets 10 are arranged in alignment with the streamwise direction of the air flow A. The tubes T on both of the upstream and downstream sides are provided with the winglets 10.

The heat transfer devices are illustrated in FIGS. 10-15 as Examples-1 to 6 according to the present invention, in which the plural winglets 10 are arranged on each side of the tube T. In each of the FIGS. 10-15, the heat transfer devices having only the tubes T on the upstream side provided with the winglets 10 are shown in the figure indicated by (A), whereas the heat transfer devices having the tubes T on both of the upstream and downstream sides provided with the winglets 10 are shown in the figures indicated by (B) and (C).

Figure 10:
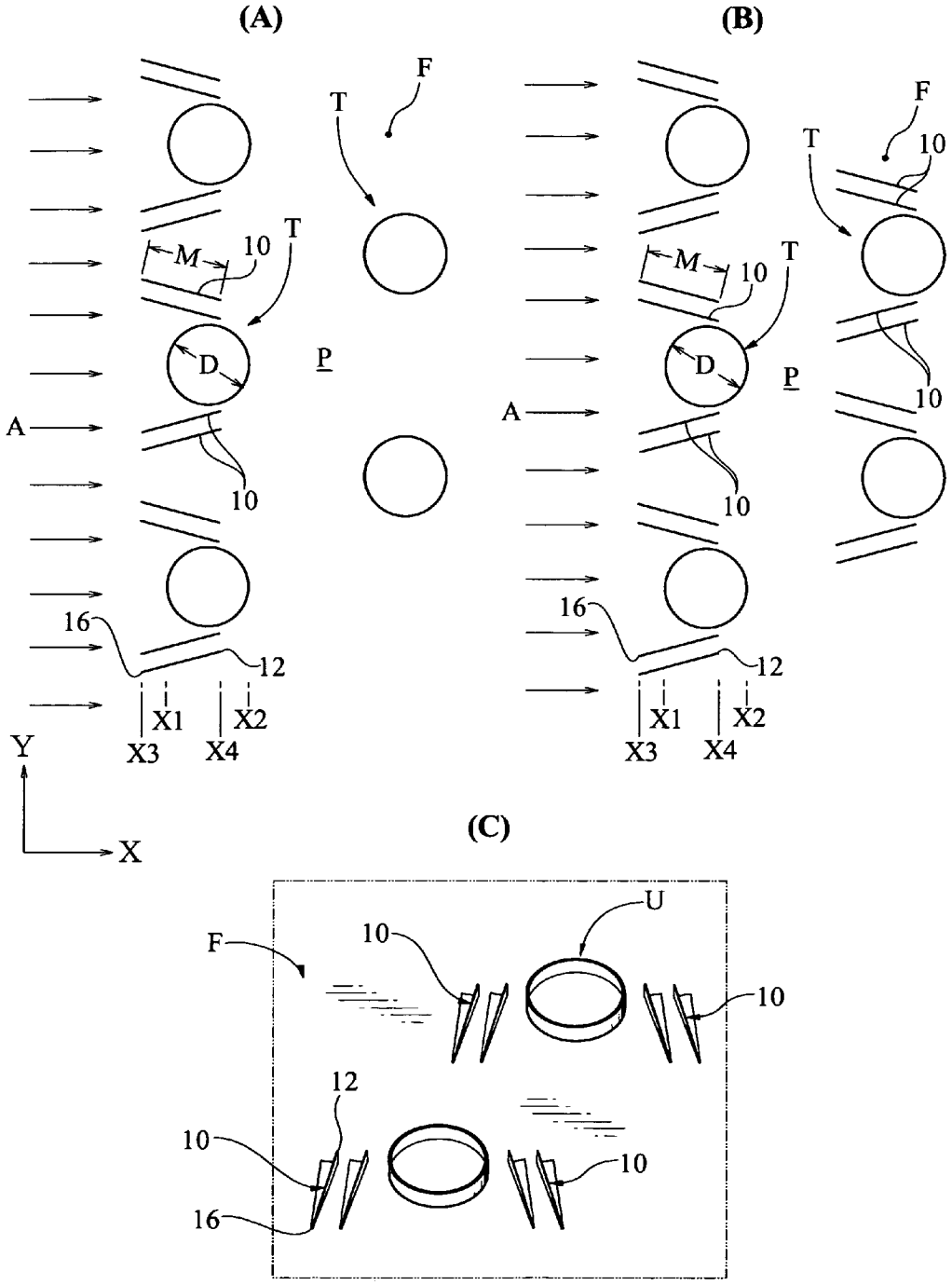
FIGS. 10, 11, 12, 13, 14 and 15 are cross-sectional and perspective views schematically illustrating arrangements of the winglets in Examples 1-6 of the heat transfer devices according to the present invention.
Figure 11:
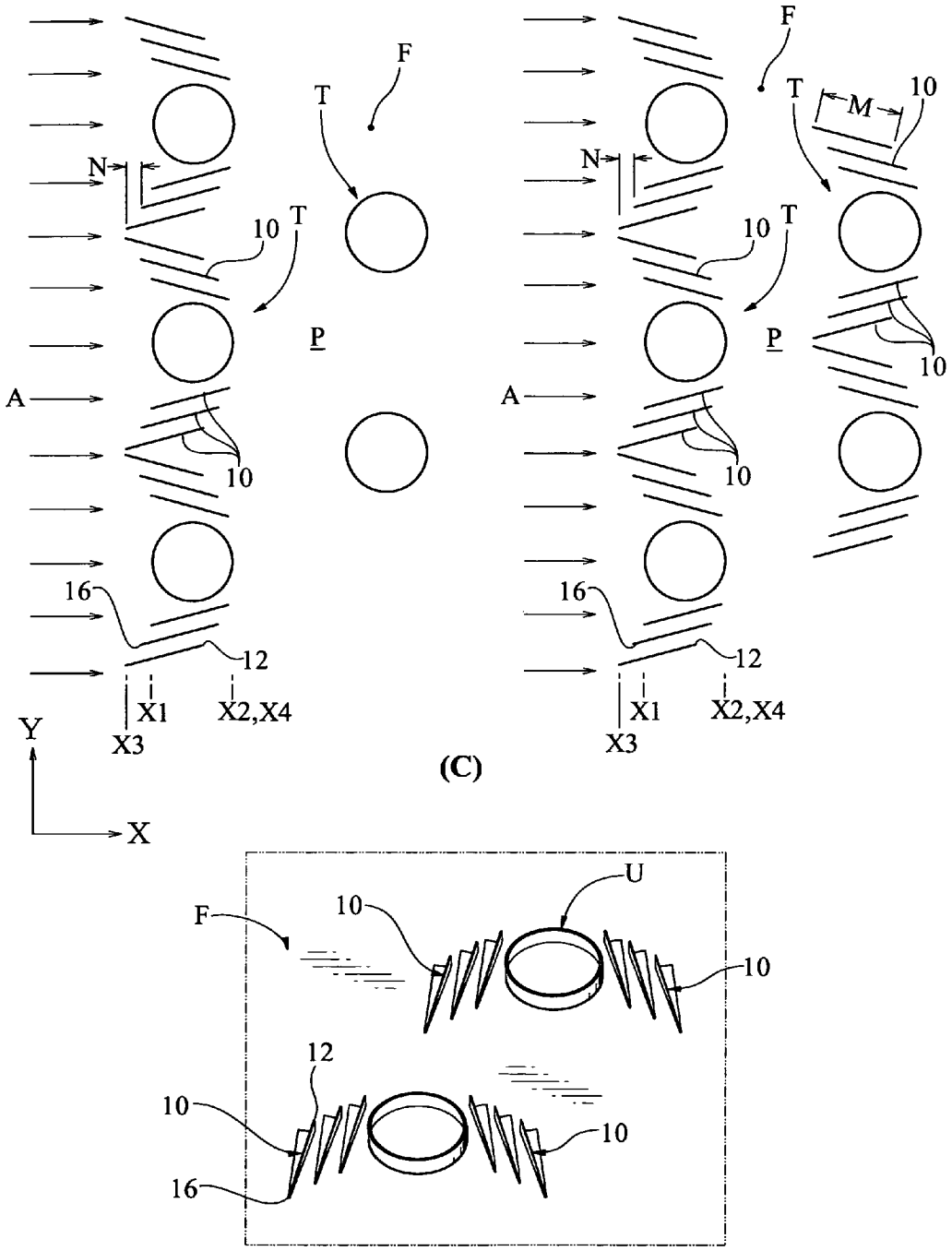
Figure 12:
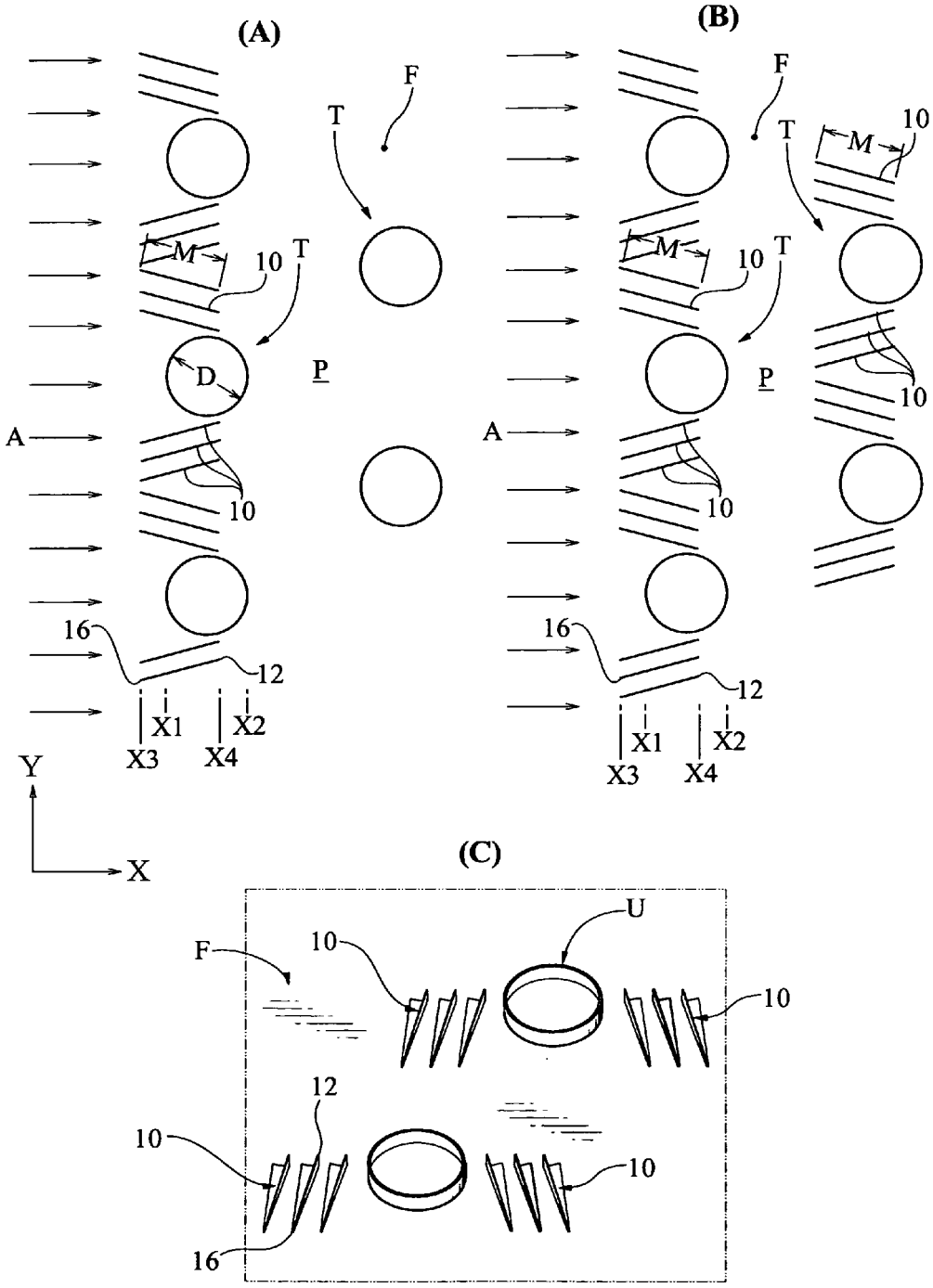

The heat transfer device as shown in FIG. 10 (Example-1) has the arrangement in which each of the tubes T is provided with the winglets 10 in two pairs. The heat transfer devices as shown in FIGS. 11, 12 and 15 (Example-2, 3, 6) have the arrangement in which each of the tubes T is provided with the winglets 10 in three pairs. Further, the heat transfer devices as shown in FIGS. 13 and 14 (Example-4, 5) have the arrangement in which each of the tubes T is provided with the winglets 10 in four pairs.

In each of the devices as shown in FIGS. 10, 12 and 15 (Example-1, 3, 6), the winglets 10 are aligned in the spanwise direction, so that the ends 16, 12 of the winglets 10 have the coordinates X3, X4 respectively. In Examples-1 and 3, upstream ends of the tubes T having the coordinates X3 are positioned on the upstream side of the upstream ends of the tubes T having the coordinates X1, and in Example-6, the coordinates X3 of the upstream ends 16 are approximately the same as the coordinates X1. The downstream ends 12 of the winglets 10 having the coordinates X4 are positioned on the upstream side of the downstream ends of the tubes T having the coordinates X2.

Figure 13:
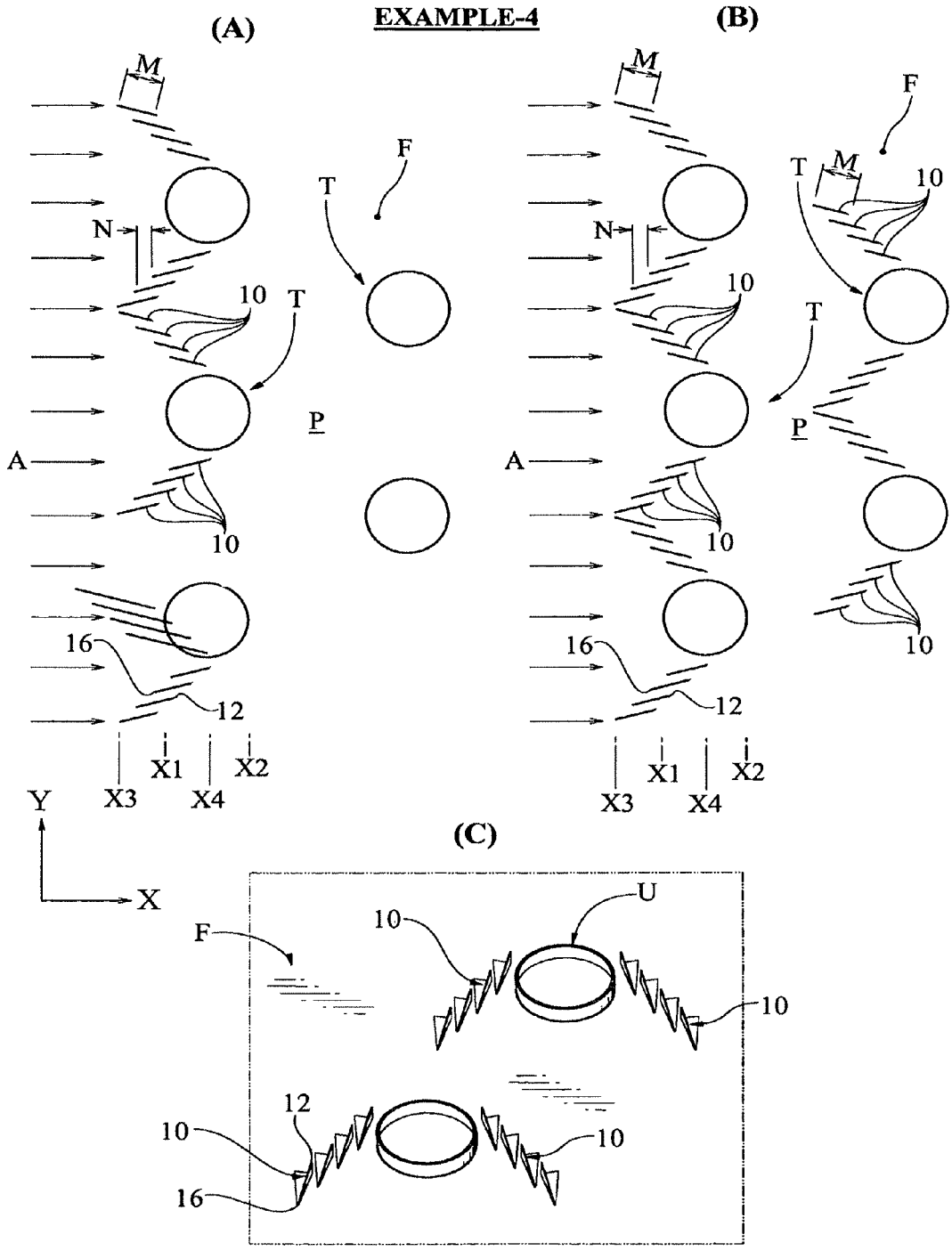
Figure 14:
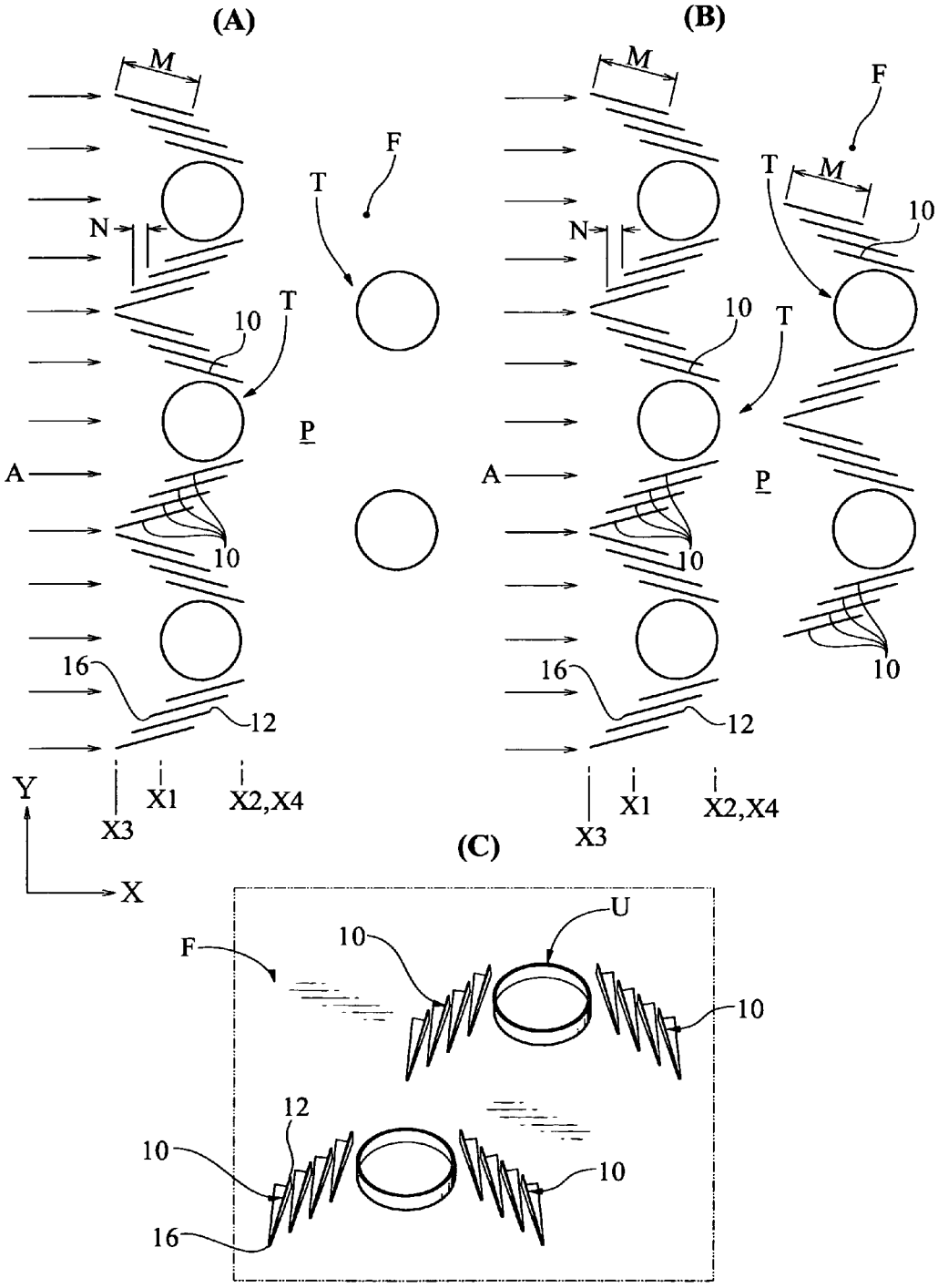
Figure 15:
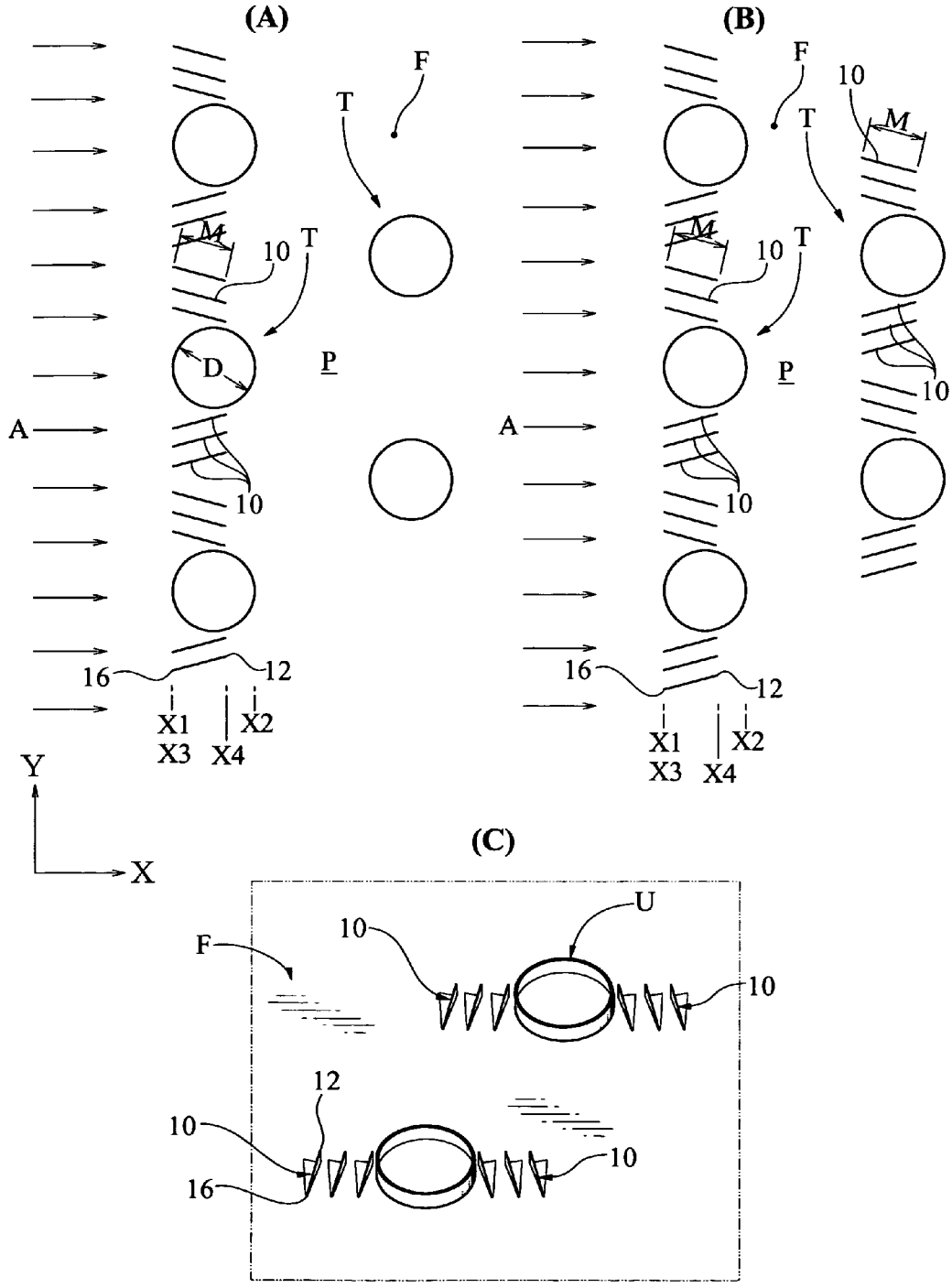

On the other hand, each of the devices as shown in FIGS. 11, 13 and 14 (Example-2, 4, 5) has the arrangement in which the winglets 10 nearer to the tube T are offset stepwise and rearward. The ends 12 of the winglets 10 nearest to the tubes T have the coordinates X4 which are the same as the coordinates X2 of the downstream ends of the tubes T, or the ends 12 are positioned on the upstream side of the downstream ends of the tubes T having the coordinates X2. The adjacent winglets 10 are offset to each other by the distance N in the direction of the X-axis. Each of the winglets 10 as shown in FIGS. 11 and 14 (Examples-2 and 5) has the overall length M which is approximately equal to or smaller than the radius R of the tube T.

In FIG. 7(A), the heat transfer enhancement ratio and the pressure loss penalty ratio are shown with respect to each of the heat transfer devices of Comparative Example-1 (FIG. 8) and Examples-1 to 5 (FIGS. 10-14). The vertical axis j/j0 shown in FIG. 7(A) indicates the heat transfer enhancement ratio which is the ratio of the dimensionless heat transfer coefficient (j) of the heat transfer device with the winglets 10 relative to the dimensionless heat transfer coefficient (j0) of the heat transfer device without the winglets (i.e., only with the plate-like fin F). This ratio is an indication representing the heat transfer effect of the winglets 10. The vertical axis f/f0 shown in FIG. 7(A) indicates the pressure loss penalty ratio which is the ratio of the pressure loss (f) of the heat transfer device with the winglets 10 relative to the pressure loss (f0) of the heat transfer device without the winglets. This ratio is an indication representing the increase of the pressure loss owing to provision of the winglets 10.

The experimental results as shown in FIG. 7 were obtained with use of the gas flow A which was adjusted in the fluid velocity so as to exhibit the Reynolds number Re=400.

As shown in FIG. 7(A), the heat exchanger of Comparative Example-1, which has the right and left winglets 10 in a pair provided for the tube T, merely represents the heat transfer enhancement ratio (j/j0) less than 1.2. Therefore, the effective heat transfer enhancement is not obtained.

On the other hand, the heat exchanger of each of Examples-1 to 5, which has the plural winglets disposed on each side of the tube T, represents the heat transfer enhancement ratio (j/j0) greater than 1.2, and the ratios (j/j0) greater than 1.4 are obtained in some cases. Therefore, the effective heat transfer enhancement can be attained.

For better understanding of this invention, the differences (j/j0−f/f0) between the heat transfer enhancement ratio and the pressure loss penalty ratio are shown in FIG. 7(B), wherein the vertical axis in the diagram of FIG. 7(B) indicates the value of (j/j0−f/f0). As shown in FIG. 7(B), the heat transfer device of each of Examples-1 to 5 can improve its heat transfer effect while restricting increase in the pressure loss, in comparison with the devices of Comparative Examples. In particular, the differences (j/j0−f/f0) in Examples-2, 3 and 5 are remarkable, which means that the heat transfer performance is considerably improved while increase in the pressure loss is restricted.

The heat exchanger of each of Examples-2, 3 and 5 has the winglets 10 in three or four pairs for the tube T. In particular, the heat exchangers of Examples-2 and 5, which have the winglets provided for the tubes T on both of the upstream and downstream sides as shown in FIGS. 11(B) and 14(B), exhibit the significant effect of improving the heat transfer performance without increase in the pressure loss.

As is apparent from comparison of Examples-4 and 5, it is preferred that the overall length of the winglet 10 is increased in order to improve the heat transfer effect while restricting increase in the pressure loss. Therefore, the length M of the winglet 10 is preferably set to be a dimension larger than the radius R of the tube T.

Figure 16:
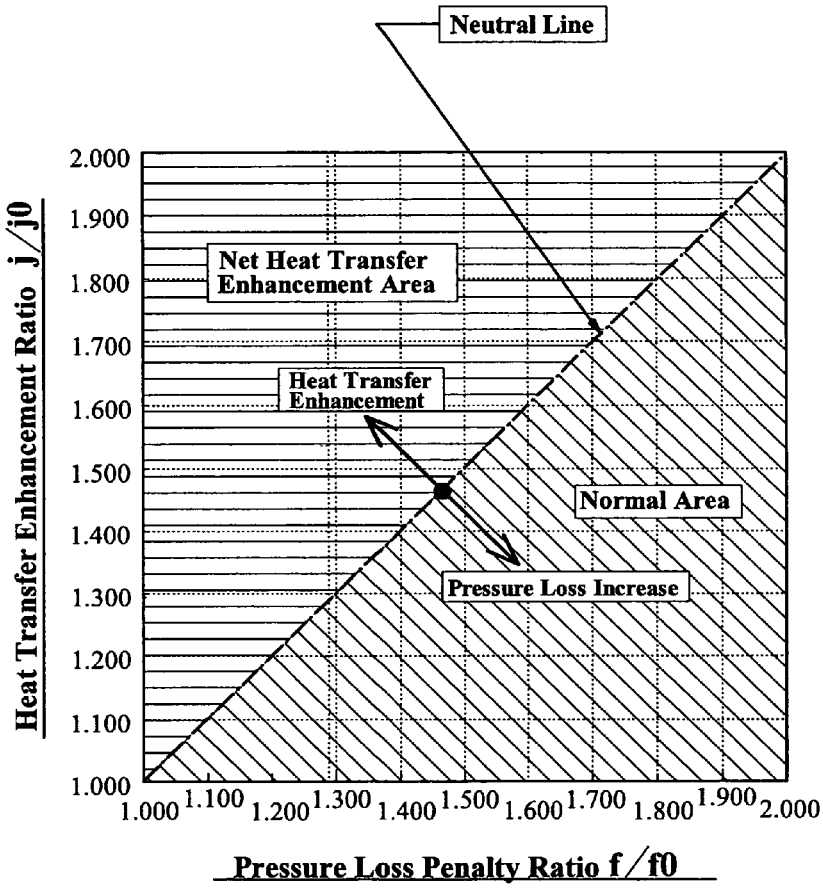
FIG. 16 is a graphic diagram showing relation between the heat transfer enhancement ratio (j/j0) and the pressure loss penalty ratio (f/f0) of the winglets in a case of the Reynolds number Re=400.

FIG. 16 is a graphic diagram showing the relation between the heat transfer enhancement ratio (j/j0) and the pressure loss penalty ratio (f/f0).

In FIG. 16, a straight neutral line inclined at an angle of 45 degrees represents the heat transfer enhancement ratio (j/j0): the pressure loss penalty ratio (f/f0)=1:1. This line indicates the characteristic in that the heat transfer performance is augmented by provision of the winglets, projections or the like but the pressure loss is also increased equivalently. In a case where the winglets, projections or the like are provided on the plate-like fin F, the pressure loss coefficient (f) is increased usually more than increase of the heat transfer coefficient (j), wherein (j/j0)/(f/f0) is a value falling under the "Normal Area".

On the other hand, the "Net Heat Transfer Enhancement Area" as shown in FIG. 16 is an area in which the value of (j/j0)/(f/f0) exceeds 1.0, wherein the heat transfer coefficient (j) is increased more than increase of the pressure loss coefficient (f), when the winglets, projections or the like are provided on the plate-like fin F.

Normally, if the flow rate of the air flow is increased for enhancement of the heat transfer performance, the property of the heat transfer device shifts to the "Normal Area" ((j/j0)/(f/f0)<1) as the Reynolds number of the air flow increases. However, if the property of the heat transfer device shifts to the "Net Heat Transfer Enhancement Area" ((j/j0)/(f/f0)>1) in spite of increase in the Reynolds number of the air flow, the heat exchanger with such a heat transfer device can achieve excellent heat transfer effect by means of increase of the fluid flow rate, while restricting increase of the pressure loss. Further, if such effects can be attained with respect to the air flow of the Reynolds number Re 500, it is possible to realize a low-noise type heat-exchanger for an air conditioner.

Figure 17:
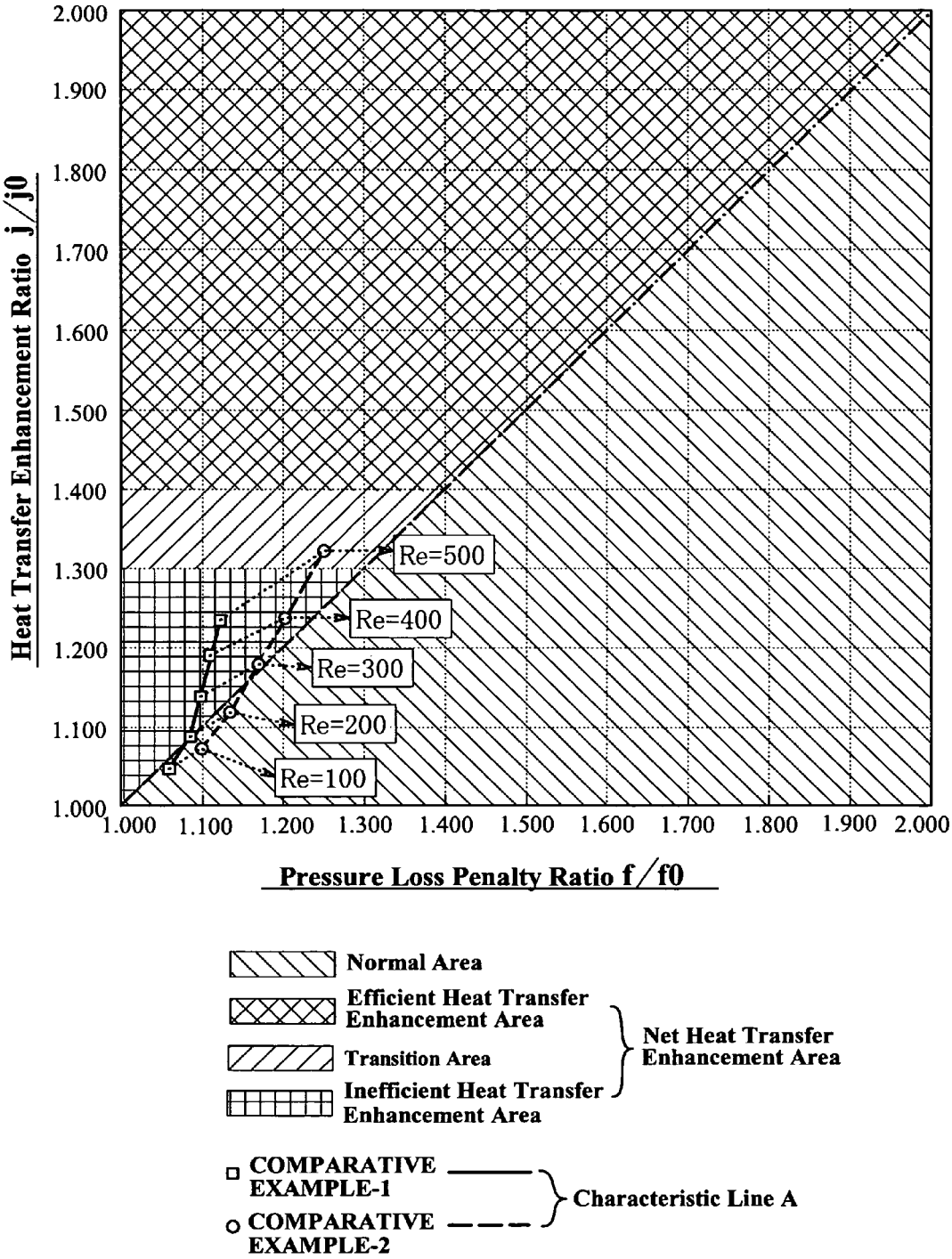
FIG. 17 is a graphic diagram showing values of (j/j0)/(f/f0) in Comparative Examples-1 and 2, wherein the values of (j/j0)/(f/f0) are plotted with respect to air flows in a range of the Reynolds number Re=100-500.

FIG. 17 are a graphic diagram of (j/j0)/(f/f0), in which the values of (j/j0)/(f/f0) in the heat transfer devices of Comparative Examples-1 and 2 are plotted with respect to the air flow A of the Reynolds number Re=100, 200, 300, 400 and 500.

In the heat transfer devices of Comparative Examples-1 and 2, Characteristic Line-A has an inclination of a large angle as shown in FIG. 17, in spite of provision of the winglet 10 on the fin F, and therefore, the value of (j/j0)/(f/f0) with respect to the air flow of the Reynolds number Re 300 falls under the value in the "Net Heat Transfer Enhancement Area". However, the heat transfer enhancement ratio (j/j0) of the air flow of the Reynolds number Re≦400 still falls under the "Inefficient Heat Transfer Enhancement Area". As regards to the air flow of the Reynolds number Re=500, the improved performance merely falls under the "Transition Area" (1.3≦(j/j0)<1.4).

Figure 18:
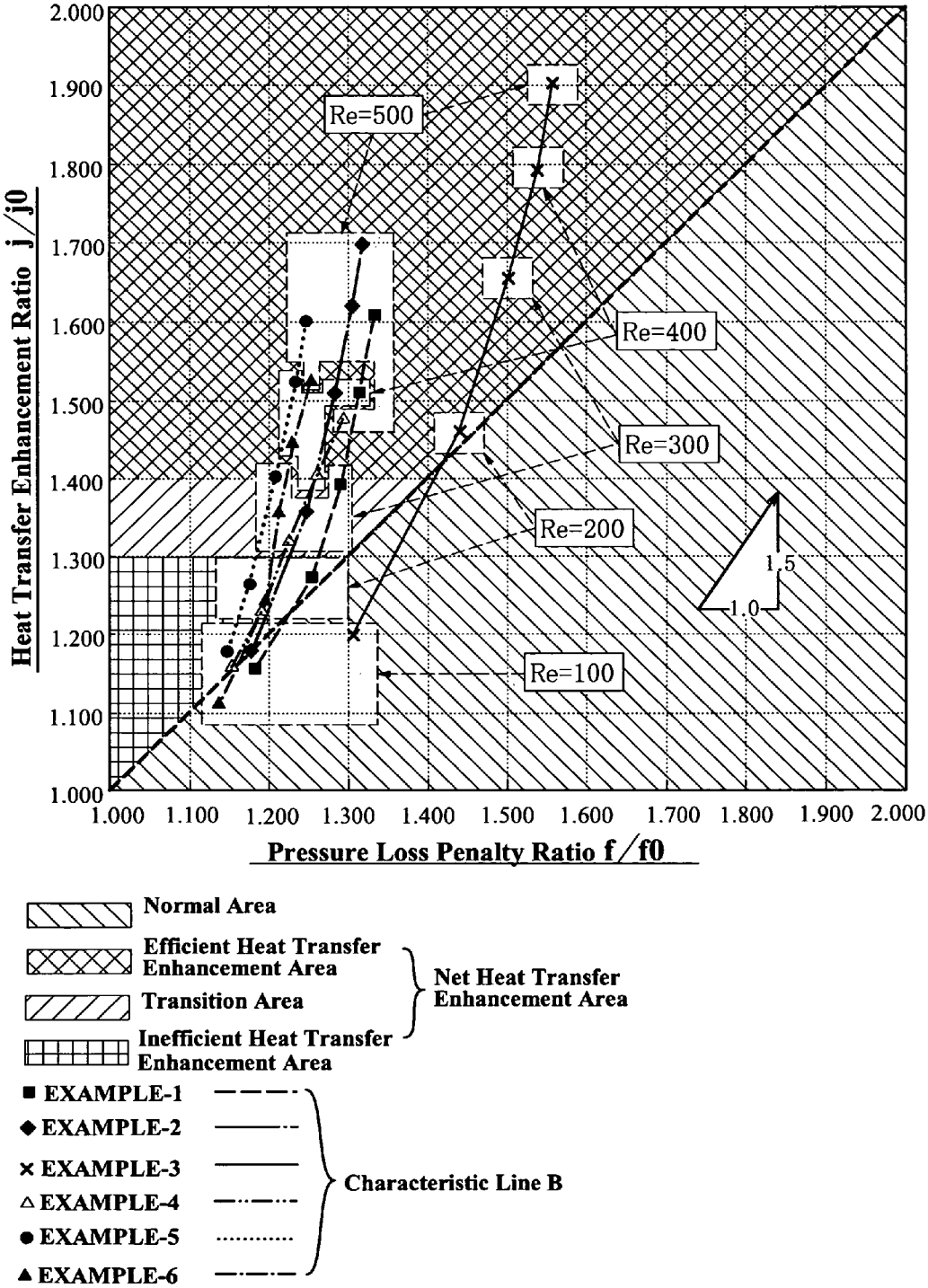
FIG. 18 is a graphic diagram showing values of (j/j0)/(f/f0) in Examples-1 to 6, wherein the values of (j/j0)/(f/f0) are plotted with respect to the air flows in a range of the Reynolds number Re=100-500.
Figure 19:
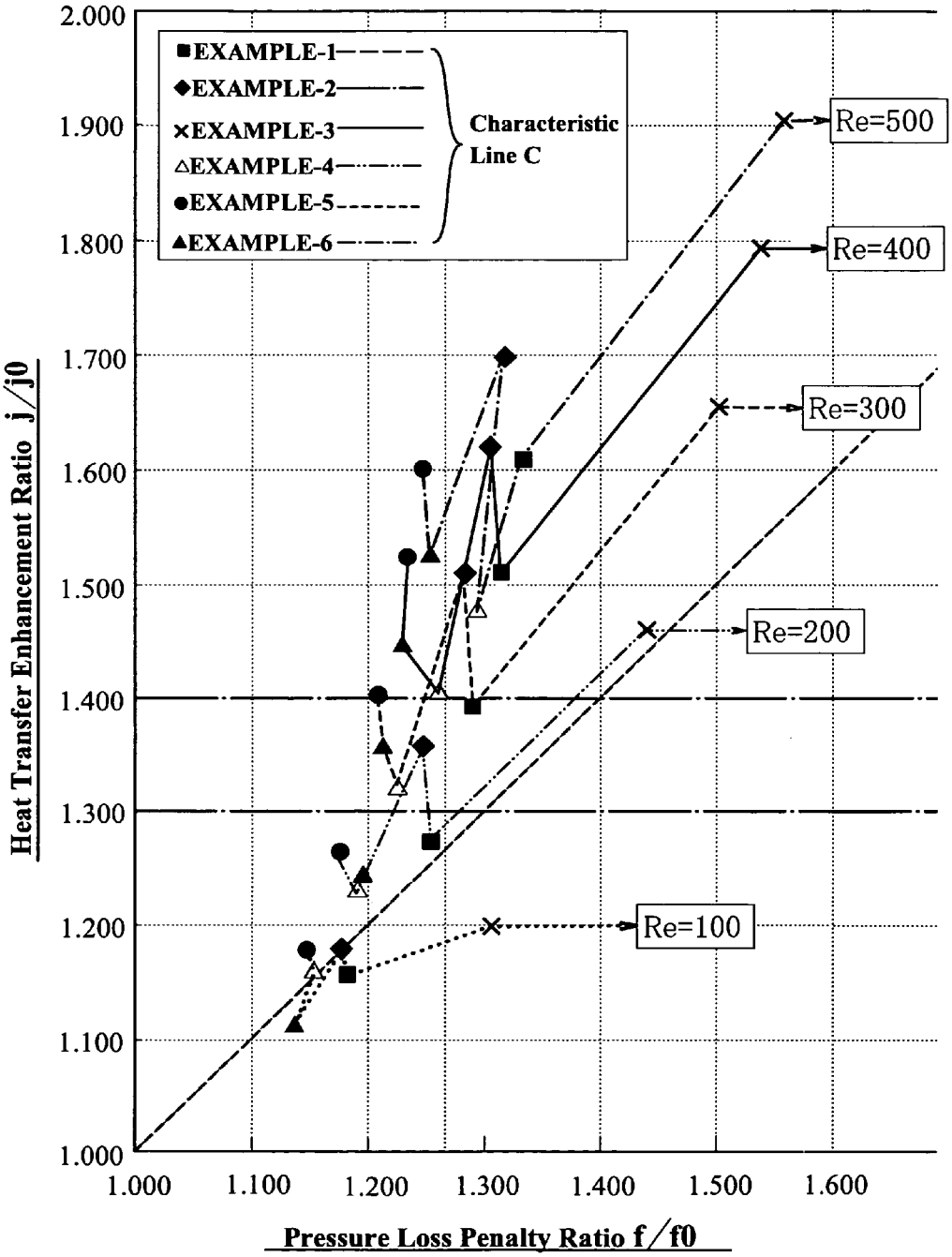
FIG. 19 is an enlarged graphic diagram showing a part of the diagram of FIG. 18.

FIG. 18 is a graphic diagram showing values of (j/j0)/(f/f0) in each of Examples-1 to 6, wherein the values of (j/j0)/(f/f0) are plotted with respect to the air flow A of the Reynolds number Re=100, 200, 300, 400 and 500. FIG. 19 is an enlarged graphic diagram showing a part of the diagram in FIG. 18. Characteristic Lines-B are shown in FIG. 18, each of Lines-B indicating change of the value (j/j0)/(f/f0) in each of the Examples. Characteristic Lines-C are shown in FIG. 19, each of the Lines-C indicating change of the value (j/j0)/(f/f0) in the same Reynolds number.

As shown in FIG. 19, the values of (j/j0)/(f/f0) in Examples-1 to 6 fall under the "Net Heat Transfer Enhancement Area", except for the air flow of the Reynolds number Re=100. In addition, most of the values (j/j0)/(f/f0) of the air flow of the Reynolds number Re≧300 fall under the "Efficient Heat Transfer Enhancement Area" (j/j0≧1.4), although some of the values fall under the "Transition Area". That is, the heat transfer devices of Examples-1 to 6 affect the high heat transfer coefficients (j) in regard to the air flows of the low Reynolds numbers.

Each of Characteristic Lines-B as shown in FIG. 18 is inclined at an angle larger than approximately 60 degrees. This angle of the inclination far exceeds the angle of inclination of the neutral line (angle of 45 degrees). That is, if the Reynolds number of the air flow is increased, the heat transfer enhancement ratio (j/j0) varies in a range of the value (j/j0)/(f/f0)>1.5, in response to change of the Reynolds number. In the heat transfer device of Examples-1 to 6, increase of the heat transfer enhancement ratio (j/j0) is remarkable in comparison with increase of the pressure loss penalty ratio (f/f0). Therefore, when the flow rate (the fluid velocity) of the air flow is increased for improvement of the heat transfer performance, significant increase or response of the heat transfer effect can be attained, in spite of insignificant increase or response of the pressure loss. The heat exchanger provided with such a heat transfer device behaves such that the pressure loss is not so changed in response to change of the flow rate (the fluid velocity), but the heat transfer performance significantly changes in response to the change of the flow rate (the fluid velocity). Thus, the heat transfer device of Examples-1 to 6 can cause the heat transfer effect to significantly vary in response to the change in the flow rate of the air flow of the low Reynolds number, while restricting the pressure loss.

Although the present invention has been described as to specific preferred embodiments and examples, the present invention is not limited to such embodiments or examples, but may be modified or changed without departing from the scope of the invention as defined in the attached claims.

For instance, the heat exchangers of the aforementioned Examples are so arranged that the heat carrier fluid at a high temperature is circulated through the heat transfer tubes T and that the cooling air flow is passed through the fluid passages P. However, the kinds of fluids and the temperatures thereof are arbitrary. For example, the heat carrier fluid at a low temperature may be circulated through the heat transfer tubes T and the air flow at a high temperature may be passed through the fluid passages P.

Further, any of fluids can be used as the thermal medium fluid circulating through the tubes T and the heat carrier fluid passing through the passage P.

Furthermore, the cross-section of the tube T is not limited to the circular section, but may be a square section, elongated round section, ellipse section, or the like.

This invention can be also applied to any type of heat transfer device which comprises a linear heat transmission member in heat transferable contact with a heat carrier fluid and a plane heat transfer fin integrally formed with the heat transmission member for heat transmission between the fin and the member.

INDUSTRIAL APPLICABILITY

The heat transfer device according to the present invention can be preferably used as a heat transfer section of a heat exchanger, especially that of a plate-fin-and-tube type heat exchanger. The heat transfer device of the present invention improves the heat transfer action while restricting increase of the pressure loss of the heat carrier fluid. The effects to be obtained from the present invention are remarkable in a heat exchanger with the flow rate of fluid flow being set at a relatively low velocity. Therefore, the present invention can be advantageously employed in a heat exchanger with the air flow rate being set at a relatively low velocity, e.g., a heat exchanger for a small scale air conditioning equipment or system.

The invention claimed is:

1. A heat transfer device comprising:

a linear or tubular heat transfer object in heat transfer contact with a heat carrier fluid, the heat transfer object having a rear end portion, a heat transfer fin which is formed integrally with the heat transfer object for heat transmission between the fin and the heat transfer object, and a plurality of longitudinal vortex generator winglets on the fin, each of which causes the fluid in vicinity of the heat transfer object to be conducted to a separation wake zone behind the heat transfer object for reducing the separation wake zone, each of which generates a longitudinal vortex behind the winglet, and each of which has a rear end;

the plurality of winglets being arranged in a spanwise direction on each side of the heat transfer object, wherein the winglets on each side are positioned parallel to each other for deflecting the fluid to the same direction and conducting the fluid to an area behind the heat transfer object;

wherein each of the winglets has a delta profile gradually decreasing in its height toward an upstream side of a flow of the fluid so that the longitudinal vortex is produced by the fluid flowing rearward beyond the winglet;

wherein adjacent winglets located on the same side of the heat transfer object are partially overlapped:

in a spanwise direction in a range of ⅓-⅔ of the winglet as seen from the downstream side of the flow so as not to cause interaction between the longitudinal vortices generated thereby, as seen from the lateral side of the flow, and as seen from the downstream side of the flow;

wherein the rear ends of said winglets are located in stepwise offsetting positions toward the heat transfer object and in a streamwise direction of the flow, and the rear end of the winglet closest to said object is placed in a lateral position or on upstream side with respect to a rear end portion of the heat transfer object; and wherein an attack angle of said winglets with respect to a streamwise direction of said fluid is set to be a predetermined angle in a range from 10 degrees to 45 degrees.

2. The heat transfer device as defined in claim 1, which has a characteristic of a heat transfer enhancement ratio (j/j0) ≧1.4 and the heat transfer enhancement ratio (j/j0)/a pressure loss penalty ratio (f/f0)>1.0 set by the vortex generator winglets with respect to the fluid of the Reynolds number Re ranging from 100 to 500, wherein the heat transfer enhancement ratio (j/j0) is defined as a ratio of a dimensionless heat transfer coefficient (j) of the heat transfer device with the winglets relative to the dimensionless heat transfer coefficient (j0) of the heat transfer device without the winglets; and wherein the pressure loss penalty ratio (f/f0) is defined as a ratio of a pressure loss coefficient (f) of the heat transfer device with the winglets relative to the pressure loss coefficient (f0) of the heat transfer device without the winglets.

3. The heat transfer device as defined in claim 1, which has a characteristic of a heat transfer enhancement ratio (j/j0) ≧1.3 and the heat transfer enhancement ratio (j/j0)/a pressure loss penalty ratio (f/f0)>1.0 with respect to the fluid of the Reynolds number Re=300, and which has the heat transfer enhancement ratio (j/j0) varying under a condition of the heat transfer enhancement ratio (j/j0)/the pressure loss penalty ratio (f/f0) >1.5, in response to change of the Reynolds number in a range from 300 to 500, wherein the heat transfer enhancement ratio (j/j0) is defined as a ratio of a dimensionless heat transfer coefficient (j) of the heat transfer device with the winglets relative to the dimensionless heat transfer coefficient (j0) of the heat transfer device without the winglets; and wherein the pressure loss penalty ratio (f/f0) is defined as a ratio of a pressure loss coefficient (f) of the heat transfer device with the winglets relative to the pressure loss coefficient (f0) of the heat transfer device without the winglets.

4. The heat transfer device as defined in claim 1, wherein the base of the delta profile of each of said winglets is positioned on a plane of said fin, and an oblique line of the delta defines an upper edge inclining toward an upstream side of the fluid flow.

5. The heat transfer device as defined in claim 1, wherein said winglets in three or four pairs are disposed on both sides of said heat transfer object in symmetry.

6. The heat transfer device as defined in claim 1, wherein said heat transfer object is a heat transfer tube having a circular cross-section, through which a thermal medium fluid to be heated or cooled can pass, and an overall length of said winglet is set to be larger than a radius of the tube.

7. The heat transfer device as defined in claim 6, wherein said overall length of the winglet is set to be larger than a diameter of the tube.

8. A heat transfer device comprising:

a linear or tubular heat transfer object in heat transfer contact with a heat carrier fluid, the heat transfer object having an upstream end portion and a rear end portion, a heat transfer fin which is formed integrally with the heat transfer object for heat transmission between the fin and the heat transfer object, and a plurality of longitudinal vortex generator winglets on the fin, each of which causes the fluid in vicinity of the heat transfer object to be conducted to a separation wake zone behind the heat transfer object for reducing the separation wake zone, each of which generates a longitudinal vortex behind the winglet, and each of which has a rear end and an upstream end;

the plurality of winglets being arranged in a spanwise direction on each side of the heat transfer object, wherein the winglets on each side are positioned parallel to each other for deflecting the fluid to the same direction and conducting the fluid to an area behind the heat transfer object;

wherein each of the winglets has a delta profile gradually decreasing in its height toward an upstream side of a flow of the fluid so that the longitudinal vortex is produced by the fluid flowing rearward beyond the winglet; and wherein the rear ends and the upstream ends of said winglets on each side of the heat transfer object are located in stepwise offsetting positions toward the heat transfer object and in a streamwise direction of the flow;

wherein adjacent winglets located on the same side of the heat transfer object are partially overlapped:

as seen from the lateral side of the flow and partially overlapped as seen from the downstream side of the flow;

wherein the rear end of the winglet closest to said heat transfer object is placed in a lateral position or on an upstream side with respect to the rear end portion of the heat transfer object, and the upstream end of the winglet remotest from the heat transfer object is placed on an upstream side of the upstream end portion of the object; and wherein an attack angle of said winglets with respect to a streamwise direction of said fluid is set to be a predetermined angle in a range from 10 degrees to 45 degrees.

9. The heat transfer device as defined in claim 8, wherein said heat transfer object is a heat transfer tube having a circular cross-section, and an overall length of the winglet is set to be larger than a diameter of the tube.

* * * * *